US010252541B2

(12) United States Patent
Ueda

(10) Patent No.: US 10,252,541 B2
(45) Date of Patent: Apr. 9, 2019

(54) DAMPER DEVICE, INK SUPPLY SYSTEM, AND INKJET PRINTER

(71) Applicant: Roland DG Corporation, Hamamatsu-shi, Shizuoka (JP)

(72) Inventor: Naoki Ueda, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/828,518

(22) Filed: Dec. 1, 2017

(65) Prior Publication Data

US 2018/0154631 A1 Jun. 7, 2018

(30) Foreign Application Priority Data

Dec. 6, 2016 (JP) ..... 2016-236884

(51) Int. Cl.

| | |
|---|---|
| ***B41J 2/18*** | (2006.01) |
| ***B41J 2/175*** | (2006.01) |
| ***B41J 2/17*** | (2006.01) |
| ***B41J 2/185*** | (2006.01) |

(52) U.S. Cl.

CPC ..... *B41J 2/18* (2013.01); *B41J 2/175* (2013.01); *B41J 2/1721* (2013.01); *B41J 2/17509* (2013.01); *B41J 2/17563* (2013.01); *B41J 2/17596* (2013.01); *B41J 2/185* (2013.01); *B41J 2002/1856* (2013.01)

(58) Field of Classification Search

CPC . B41J 2/18; B41J 2/185; B41J 2/17596; B41J 2/175; B41J 2/1721; B41J 2/17509; B41J 2/17563; B41J 2002/1856

See application file for complete search history.

(56) References Cited

U.S. PATENT DOCUMENTS

| | | | | |
|---|---|---|---|---|
| 9,925,791 | B2 * | 3/2018 | Yamada | B41J 2/17563 |
| 2013/0169710 | A1 * | 7/2013 | Keefe | B41J 2/175 347/17 |
| 2014/0125745 | A1 | 5/2014 | Igawa | |

FOREIGN PATENT DOCUMENTS

JP 2014-094460 A 5/2014

OTHER PUBLICATIONS

Atsumi, "Diaphragm Pump, Ink Supply System, and Inkjet Printer," U.S. Appl. No. 15/828,520, filed Dec. 1, 2017.

* cited by examiner

*Primary Examiner* — Geoffrey S Mruk

(74) *Attorney, Agent, or Firm* — Keating & Bennett, LLP

(57) ABSTRACT

A damper device includes an upstream damper provided upstream of an ink head and a downstream damper provided downstream of the ink head. The upstream damper includes an upstream ink chamber communicating with an upstream inflow port and an upstream outflow port and storing ink, and an upstream detector that detects an amount of ink stored in the upstream ink chamber. The downstream damper includes a downstream ink chamber communicating with a downstream inflow port and a downstream outflow port and storing ink, and a downstream detector that detects an amount of ink stored in the downstream ink chamber.

13 Claims, 10 Drawing Sheets

DAMPER DEVICE, INK SUPPLY SYSTEM, AND INKJET PRINTER

CROSS REFERENCE TO RELATED APPLICATIONS

This application claims the benefit of priority to Japanese Patent Application No. 2016-236884 filed on Dec. 6, 2016. The entire contents of this application are hereby incorporated herein by reference.

BACKGROUND OF THE INVENTION

1. Field of the Invention

The present invention relates to a damper device, an ink supply system including the damper device, and an inkjet printer including the ink supply system.

2. Description of the Related Art

As an example of an inkjet printer, JP 2014-094460 A, for example, discloses an inkjet printer furnished with an ink head for ejecting ink and an ink tank for storing ink to be supplied to the ink head.

In the inkjet printer disclosed in JP 2014-094460 A, the ink head and the ink tank are connected by a normal flow channel. The normal flow channel is provided with a damper device and feed pumps that serve to feed the ink supplied from the ink tank to the ink head while reducing pressure fluctuations of the ink. The damper device is provided with an outlet port. This outlet port and the normal flow channel are connected to a circulation flow channel. Thus, in the inkjet printer disclosed in JP 2014-094460 A, the ink circulates in the flow channel provided between the ink tank and the ink head.

As another example of the inkjet printer, it is possible to conceive a printer in which ink is circulated through a circulation channel including an ink head, in other words, a printer in which its circulation flow channel is connected to an ink head and a normal flow channel. When the damper device disclosed in JP 2014-094460 A is used for such an inkjet printer in which ink is circulated through a circulation channel including an ink head, the damper device may not be able to appropriately reduce pressure fluctuations, and consequently, the ink head may not be able to eject ink appropriately.

SUMMARY OF THE INVENTION

In view of the foregoing and other problems, preferred embodiments of the present invention provide damper devices used for inkjet printers in which ink is circulated through a circulation channel including an ink head, ink supply systems including the same, and inkjet printers including the same.

A damper device according to a preferred embodiment of the present invention is a damper device for use in an inkjet printer including an ink head ejecting ink, an upstream flow channel connected to the ink head and through which the ink flows into the ink head, and a downstream flow channel connected to the ink head and into which the ink flows out from the ink head. The damper device includes an upstream damper provided in the upstream flow channel and a downstream damper provided in the downstream flow channel. The upstream damper includes an upstream inflow port, an upstream ink chamber, an upstream outflow port, and an upstream detector. The upstream inflow port allows the ink to flow into the upstream damper. The upstream ink chamber communicates with the upstream inflow port and stores the ink. The upstream outflow port communicates with the upstream ink chamber and allows the ink to flow out of the upstream damper. The upstream detector detects an amount of the ink stored in the upstream ink chamber. The downstream damper includes a downstream inflow port, a downstream ink chamber, a downstream outflow port, and a downstream detector. The downstream inflow port allows the ink to flow into the downstream damper. The downstream ink chamber communicates with the downstream inflow port and stores the ink. The downstream outflow port communicates with the downstream ink chamber and allows the ink to flow out of the downstream damper. The downstream detector detects an amount of the ink stored in the downstream ink chamber.

In this damper device, the upstream damper is provided in a flow channel upstream of the ink head, and the downstream damper is provided in a flow channel downstream of the ink head. As a result, it is possible to reduce pressure fluctuations in the flow channel that is upstream of the ink head and in the flow channel that is downstream of the ink head, based on a detection result obtained by the upstream detector and a detection result obtained by the downstream detector. Therefore, it is easy to keep the pressure in the ink head at a negative pressure, thus enabling the ink head to eject ink appropriately at the time of printing. This makes it possible to use the damper device according to preferred embodiments of the present invention in such an inkjet printer in which ink is circulated through a circulation channel including an ink head.

Various preferred embodiments of the present invention make it possible to provide damper devices used for inkjet printers in which ink is circulated in a circulation channel including an ink head.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinbelow, ink supply systems including damper devices and inkjet printers including the ink supply systems according to preferred embodiments of the present invention will be described with reference to the drawings. The preferred embodiments described herein are, of course, not intended to limit the present invention. The features and components that exhibit the same effects are denoted by the same reference symbols, and repetitive description thereof may be omitted as appropriate.

Figure 1:
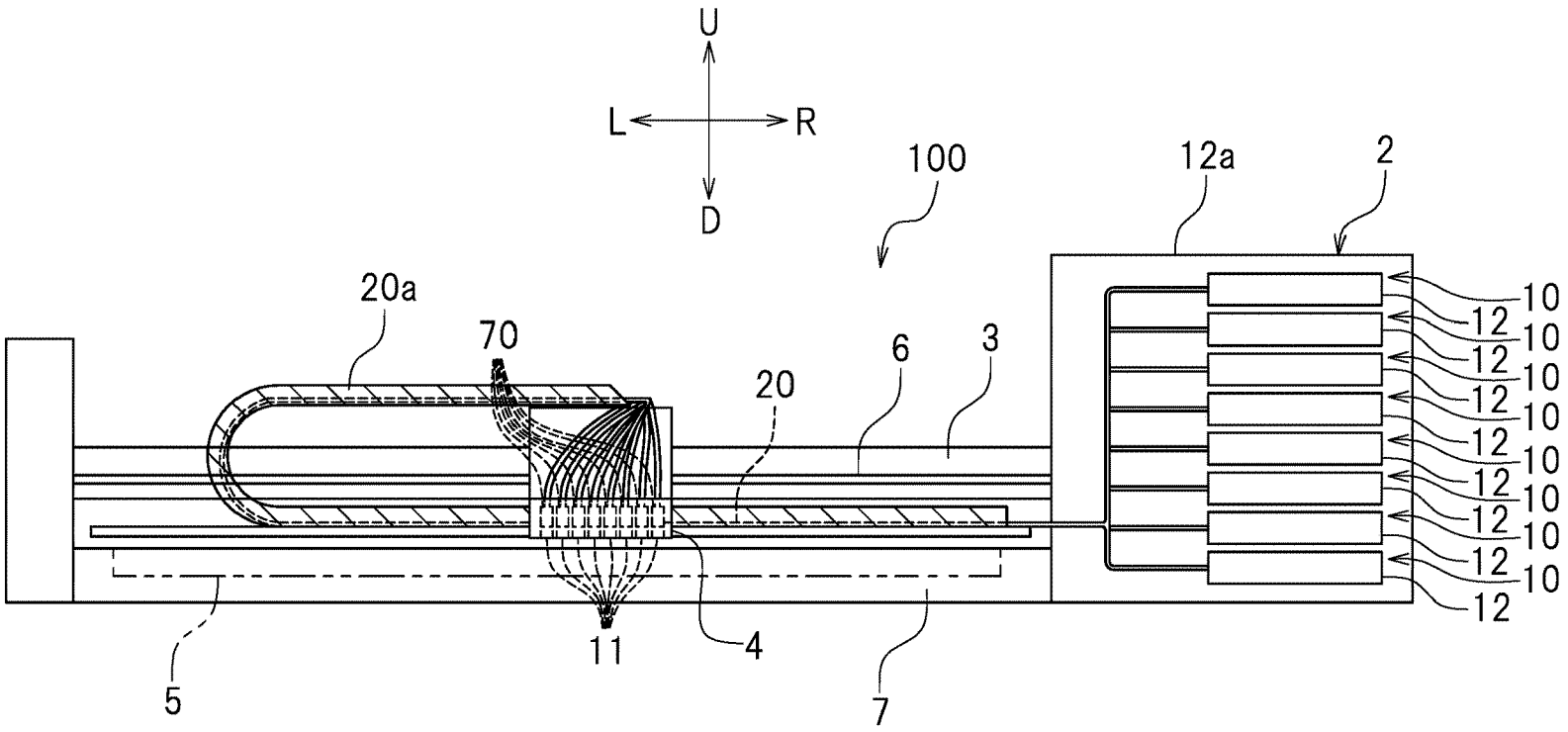
FIG. 1 is a front view illustrating a printer according to a preferred embodiment of the present invention.

FIG. 1 is a front view illustrating an inkjet printer (hereinafter simply "printer") 100 according to a preferred embodiment of the present invention. The printer 100 is an inkjet printer. The term "inkjet" in the description of preferred embodiments herein is intended to include various types of inkjet printing, including various continuous printing such as binary deflection printing and a continuous deflection printing, and various on-demand printing such as thermal printing and piezoelectric printing. In the following description, reference characters F, Rr, L, R, U, and D in the drawings respectively represent front, rear, left, right, up, and down when the printer 100 is viewed from the front. The just-mentioned directional terms are, however, merely provided for purposes in illustration and are not intended to limit in any way the manner in which the printer 100 should be arranged.

As illustrated in FIG. 1, the printer 100 prints on a recording medium 5. In the present preferred embodiment, the recording medium 5 may be recording paper in a roll form, i.e., what is called roll paper. The recording medium 5 is, however, not limited to recording paper in a roll form. For example, the recording medium 5 may be a resin sheet. Moreover, the recording medium 5 is not limited to a flexible sheet. For example, the recording medium 5 may be a medium made of a hard material, such as glass substrate. In the present preferred embodiment, the material that forms the recording medium 5 is not limited to a particular material.

In the present preferred embodiment, the printer 100 includes a printer main body 2 and a guide rail 3 secured to the printer main body 2. The guide rail 3 extends, for example, along a leftward or rightward direction. Herein, a carriage 4 is engaged with the guide rail 3. The carriage 4 is slidable along the guide rail 3. Although not shown in the drawings, rollers are provided respectively at the left and right ends of the guide rail 3. One of the rollers is connected to a carriage motor (not shown). The one of the rollers that is connected to the carriage motor is rotated by the carriage motor. An endless belt 6 is wound around the rollers provided at both ends of the guide rail 3. The carriage 4 is secured to the belt 6. By actuating the carriage motor, the rollers are rotated to thereby run the belt 6. As the belt 6 runs, the carriage 4 moves in a leftward or rightward direction. Thus, the carriage 4 is movable in a leftward or rightward direction along the guide rail 3.

In the present preferred embodiment, the printer main body 2 is provided with a platen 7 on which the recording medium 5 is to be placed. The platen 7 supports the recording medium 5 when a printing operation is performed on the recording medium 5. The platen 7 is provided with a grit roller (not shown) and pinch rollers (not shown), which are arranged vertically to define a pair. The grit roller is coupled to a feed motor (not shown). The grit roller is caused to rotate by the feed motor. By rotating the grit roller with the recording medium 5 pinched between the grit roller and the pinch rollers, the recording medium 5 is delivered in a frontward or rearward direction.

In the present preferred embodiment, the printer 100 includes a plurality of ink supply systems 10. Each of the ink supply systems 10 supplies ink from an ink tank 12 to an ink head 11. Each of the ink supply systems 10 also serves to circulate the ink supplied to the ink head 11. The ink supply system 10 is provided for each one of the ink heads 11. In other words, the ink supply system 10 is provided for each one of the ink tanks 12. In the present preferred embodiment, the number of the ink heads 11 is "8", so the number of the ink supply systems 10 is accordingly "8". However, the number of the ink heads 11, the number of the ink tanks 12, and the number of the ink supply systems 10 are not limited to particular numbers. Note that the plurality of ink supply systems 10 preferably have the same structure. On that basis, the following description details the configuration of one ink supply system 10.

Figure 2:
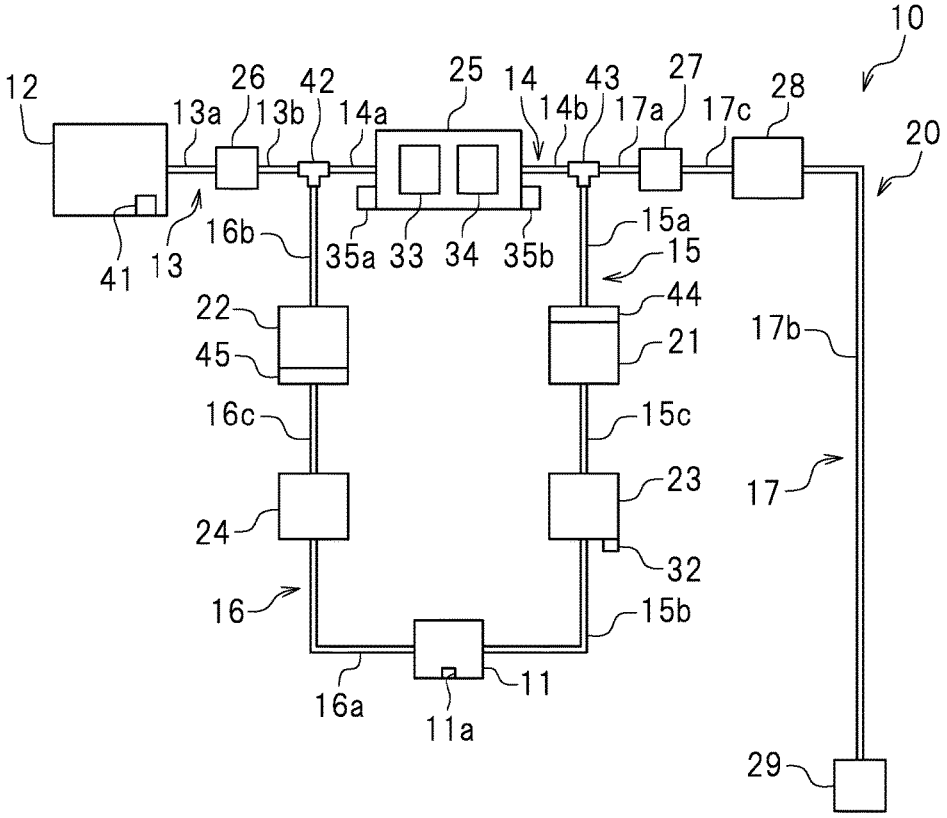
FIG. 2 is a schematic view illustrating an ink supply system.

FIG. 2 is a schematic view illustrating the ink supply system 10. As illustrated in FIG. 2, the ink supply system 10 includes an ink head 11, an ink tank 12, an ink flow channel 20, an upstream pump 21, a downstream pump 22, an upstream damper 23, a downstream damper 24, an air trap 25, an inlet valve 26, an outlet valve 27, and an outlet pump 28. In the following description, the term "upstream" refers to where the ink flows into the ink head 11 from. The term "downstream" refers to where the ink flows from the ink head 11 into.

As illustrated in FIG. 1, the ink head 11 ejects ink onto the recording medium 5 that is placed on the platen 7. As illustrated in FIG. 2, a nozzle 11*a* is provided in the bottom surface of the ink head 11. As illustrated in FIG. 1, the ink head 11 is mounted on the carriage 4. The ink head 11 is movable in a leftward or rightward direction along the guide rail 3 via the carriage 4. More specifically, by actuating the carriage motor for running the belt 6, the ink head 11 are moved in a leftward or rightward direction along with the carriage 4.

The ink tank 12 stores ink. In the present preferred embodiment, the number of ink tanks 12 is equal to the number of ink heads 11. Herein, the number of ink tanks 12 is set to "8". One ink head 11 is connected to each one of the ink tanks 12. The inks stored in the ink tanks 12 are supplied to the ink heads 11. The ink stored in one of the ink tanks 12 may be, for example, any one of process color inks, such as cyan ink, magenta ink, yellow ink, light cyan ink, light magenta ink, and black ink, and spot color inks, such as white ink, metallic ink, and clear ink. In the present preferred embodiment, an ink of the same color is stored in two ink tanks 12 among the eight ink tanks 12. For example, the eight ink supply systems 10 may be grouped into four groups, the first group, the second group, the third group, and the fourth group. Each of the groups includes two ink supply systems 10. In this case, for example, the ink tanks 12 in the first group of the ink supply systems 10 store cyan ink. The ink tanks 12 in the second group of the ink supply systems 10 store magenta ink. The ink tanks 12 in the third group of the ink supply systems 10 store yellow ink. The ink tanks 12 in the fourth group of the ink supply systems 10 store black ink. However, it is also possible that the plurality of ink tanks 12 may store different inks from each other. Although not shown in the drawings, each of the ink tanks 12 is provided with an ink outlet port (not shown).

Note that the positions of the ink tanks 12 to be arranged are not limited to particular positions. In the present preferred embodiment, the ink tanks 12 are attachable to and detachable from the printer main body 2. More specifically, for example, the printer main body 2 includes an accommodation section 12*a*, as illustrated in FIG. 1. The plurality of ink tanks 12 are accommodated in the accommodation section 12*a*. However, the positions of the ink tanks 12 are not limited to particular positions. For example, the ink tanks 12 may be attachable to and detachable from the carriage 4.

As illustrated in FIG. 2, the ink tank 12 may be provided with a detection sensor 41 that detects the amount of the ink stored in the ink tank 12. The detection sensor 41 is not limited to a particular type of detection sensor. For example, the detection sensor 41 may be a photo interrupter. For example, the detection sensor 41 detects that the amount of ink stored in the ink tank 12 is a predetermined amount that has been determined in advance.

The ink flow channel 20 is a flow channel that supplies the ink stored in the ink tank 12 to the ink head 11 and also allows the ink within the ink head 11 to circulate therethrough. As illustrated in FIG. 1, in the present preferred embodiment, at least a portion of the ink flow channel 20 is covered with a cable protection and guide device 20*a*. The cable protection and guide device 20*a* may be, for example, a Cableveyor (registered trademark). As illustrated in FIG. 2, the ink flow channel 20 includes an inlet flow channel 13, a connection flow channel 14, an upstream flow channel 15, a downstream flow channel 16, and an outlet flow channel 17.

The inlet flow channel 13 is a flow channel that supplies the ink stored in the ink tank 12 to the connection flow channel 14. One end of the inlet flow channel 13 is detachably connected to the ink tank 12. The other end of the inlet flow channel 13 is connected to the connection flow channel 14. In the present preferred embodiment, the inlet flow channel 13 includes a first inlet section 13*a* and a second inlet section 13*b*. The first inlet section 13*a* includes one end of the inlet flow channel 13. The first inlet section 13*a* is detachably connected to the ink tank 12. The first inlet section 13*a* has a structure that prevents ink from leaking from one end of the inlet flow channel 13 when the ink tank 12 is removed from the one end of the inlet flow channel 13. The second inlet section 13*b* includes the other end of the inlet flow channel 13. The second inlet section 13*b* is connected to the connection flow channel 14.

The connection flow channel 14 is a flow channel that supplies the ink supplied to the inlet flow channel 13 to the upstream flow channel 15. The connection flow channel 14 is a flow channel that connects the inlet flow channel 13 and the upstream flow channel 15 to each other. One end of the connection flow channel 14 is connected to the other end of the inlet flow channel 13. In the present preferred embodiment, the one end of the connection flow channel 14 is provided with a three-way valve 42. The one end of the connection flow channel 14 is connected to the other end of the inlet flow channel 13 via the three-way valve 42. The other end of the connection flow channel 14 is connected to the upstream flow channel 15. Herein, the connection flow channel 14 includes a first connection section 14*a* and a second connection section 14*b*. The first connection section 14*a* includes the one end of the inlet flow channel 14. The first connection section 14*a* is connected to the second inlet section 13*b* via the three-way valve 42. The second connection section 14*b* includes the other end of the inlet flow channel 14. The second connection section 14*b* is connected to the upstream flow channel 15.

The upstream flow channel 15 is a flow channel that supplies the ink supplied to the connection flow channel 14 to the ink head 11. One end of the upstream flow channel 15 is connected to the other end of the connection flow channel 14. Herein, a three-way valve 43 is provided at the one end of the upstream flow channel 15. The one end of the upstream flow channel 15 is connected to the other end of the connection flow channel 14 via the three-way valve 43. The other end of the upstream flow channel 15 is connected to the ink head 11. In the present preferred embodiment, the upstream flow channel 15 includes a first upstream section 15*a*, a second upstream section 15*b*, and a middle upstream section 15*c*. The first upstream section 15*a* includes the one end of the upstream flow channel 15. The first upstream section 15*a* is connected to the second connection section 14*b* via the three-way valve 43. The second upstream section 15*b* includes the other end of the upstream flow channel 15. The second upstream section 15*b* is connected to the ink head 11. The middle upstream section 15*c* is positioned between the first upstream section 15*a* and the second upstream section 15*b*. The middle upstream section 15*c* is connected to the first upstream section 15*a* and the second upstream section 15*b*.

The downstream flow channel 16 is a flow channel into which the ink within the ink head 11 flows out. The downstream flow channel 16 is a flow channel that causes the ink within the ink head 11 to flow to the connection flow channel 14. Herein, one end of the downstream flow channel 16 is connected to the ink head 11. The other end of the downstream flow channel 16 is connected to one end of the connection flow channel 14. More specifically, the other end of the downstream flow channel 16 is connected to the one end of the connection flow channel 14 and the other end of the inlet flow channel 13 via the three-way valve 42. In the present preferred embodiment, the downstream flow channel 16 includes a first downstream section 16*a*, a second downstream section 16*b*, and a middle downstream section 16*c*. The first downstream section 16*a* includes the one end of the downstream flow channel 16. The first downstream section 16*a* is connected to the ink head 11. The second downstream section 16*b* includes the other end of the downstream flow channel 16. The second downstream section 16*b* is connected to the second inlet section 13*b* and the first connection section 14*a* via the three-way valve 43. The middle downstream section 16*c* is positioned between the first downstream section 16*a* and the second downstream section 16*b*. The middle downstream section 16*c* is connected to the first downstream section 16*a* and the second downstream section 16*b*.

The outlet flow channel 17 is a flow channel that drains the ink within the inlet flow channel 13, the connection flow channel 14, the upstream flow channel 15, and the downstream flow channel 16, out of these flow channels. One end of the outlet flow channel 17 is connected to the other end of the connection flow channel 14. More specifically, the one end of the outlet flow channel 17 is connected to the other end of the connection flow channel 14 and the one end of the upstream flow channel 15 via the three-way valve 43. In the present preferred embodiment, the other end of the outlet flow channel 17 is connected to a waste ink tank 29. The waste ink tank 29 is a tank into which ink is drained when the ink flowing through the ink flow channel 20 of the ink supply system 10, for example, is discharged.

In the present preferred embodiment, the outlet flow channel 17 includes a first outlet section 17*a*, a second outlet section 17*b*, and a middle outlet section 17*c*. The first outlet section 17*a* includes one end of the outlet flow channel 17. The first outlet section 17*a* is connected to the second connection section 14*b* and the first upstream section 15*a* via the three-way valve 43. The second outlet section 17*b* includes the other end of the outlet flow channel 17. The second outlet section 17*b* is connected to the waste ink tank 29. The middle outlet section 17*c* is positioned between the first outlet section 17*a* and the second outlet section 17*b*. The middle outlet section 17*c* is connected to the first outlet section 17*a* and the second outlet section 17*b*.

In the present preferred embodiment, the ink flow channel 20 may be defined by a tube having flexibility. More specifically, each of the inlet flow channel 13, the connection flow channel 14, the upstream flow channel 15, the downstream flow channel 16, and the outlet flow channel 17 may be defined by a tube having flexibility. However, the type and material of the inlet flow channel 13, the connection flow channel 14, the upstream flow channel 15, the downstream flow channel 16, and the outlet flow channel 17 are not limited to a particular type or a particular material.

The upstream pump 21 and the downstream pump 22 serve to supply ink. The upstream pump 21 is a pump that supplies ink toward the ink head 11, and the upstream pump 21 adjusts the flow rate of the ink flowing into the ink head 11. The downstream pump 22 is a pump that recirculates the ink that has flowed out of the ink head 11 and thus allowing the ink to flow into the connection flow channel 14. The downstream pump 22 adjusts the flow rate of the ink flowing out from the ink head 11. In the present preferred embodiment, the upstream pump 21 is provided in the upstream flow channel 15. More specifically, the upstream pump 21 is provided between the first upstream section 15*a* and the middle upstream section 15*c* of the upstream flow channel 15. The downstream pump 22 is provided in the downstream flow channel 16. More specifically, the downstream pump 22 is provided between the middle downstream section 16*c* and the second downstream section 16*b* of the downstream flow channel 16. Herein, the ink head 11 is disposed between the upstream pump 21 and the downstream pump 22. Accordingly, the flow rate of ink is adjusted by the upstream pump 21, whereby the pressure in the flow channel upstream of the ink head 11 (which is the upstream flow channel 15 herein) is adjusted. The pressure in the flow channel downstream of the ink head 11 (which is the downstream flow channel 16 herein) is adjusted by the downstream pump 22. Thus, by adjusting the pressures in the flow channels upstream and downstream of the ink head 11, the pressure in the ink head 11 is adjusted, and so that the ink is ejected according to the pressure in the ink head 11.

In the present preferred embodiment, the type of the upstream pump 21 and the type of the downstream pump 22 are the same. However, the upstream pump 21 may be a different type of pump from the downstream pump 22. Herein, both the upstream pump 21 and the downstream pump 22 are a diaphragm pump. However, the type of each of the upstream pump 21 and the downstream pump 22 is not limited to any particular type. Although not shown in the drawings, each of the upstream pump 21 and the downstream pump 22 includes a diaphragm that is elastically deformable, and a pump motor that elastically deforms the diaphragm. By actuating the pump motor to elastically deform the diaphragm, the upstream pump 21 and the downstream pump 22 adjust the flow rate of the ink. In the present preferred embodiment, the phrases "the upstream pump 21 is actuated" and "the downstream pump 22 is actuated" each mean a state in which the pump motor is actuated and the diaphragm is elastically deformed.

In the present preferred embodiment, for example, the upstream pump 21 is provided with an inflow port (not shown) allowing ink to flow into the upstream pump 21. The inflow port of the upstream pump 21 may be provided with an upstream filter 44 to capture impurities such as dregs in the ink flow channel 20. This reduces the risk of problems resulting from entry of impurities into the upstream pump 21. Likewise, the downstream pump 22 is provided with an inflow port (not shown) allowing ink to flow into the downstream pump 22. The inflow port of the downstream pump 22 may also be provided with a downstream filter 45 to capture impurities such as dregs in the ink flow channel 20. This reduces the risk of problems resulting from entry of impurities into the downstream pump 22.

Next, the upstream damper 23 and the downstream damper 24 will be described. The upstream damper 23 and the downstream damper 24 alleviate ink pressure fluctuations to stabilize the ink ejection operation of the ink head 11. The upstream damper 23 is capable of detecting the flow rate of the ink flowing into the upstream damper 23. The actuation of the upstream pump 21 is controlled based on the flow rate detected by the upstream damper 23. The downstream damper 24 is capable of detecting the flow rate of the ink flowing into the downstream damper 24. The actuation of the downstream pump 22 is controlled based on the flow rate detected by the downstream damper 24.

In the present preferred embodiment, the upstream damper 23 is provided in the upstream flow channel 15. More specifically, the upstream damper 23 is provided at a portion of the upstream flow channel 15 that is closer to the ink head 11 than is the upstream pump 21. In the present preferred embodiment, the upstream damper 23 is provided between the middle upstream section 15*c* and the second upstream section 15*b* of the upstream flow channel 15. The downstream damper 24 is provided in the downstream flow channel 16. More specifically, the downstream damper 24 is provided at a portion of the downstream flow channel 16 that is closer to the ink head 11 than is the downstream pump 22. In the present preferred embodiment, the downstream damper 24 is provided between the first downstream section 16*a* and the middle downstream section 16*c* of the downstream flow channel 16.

Figure 3:
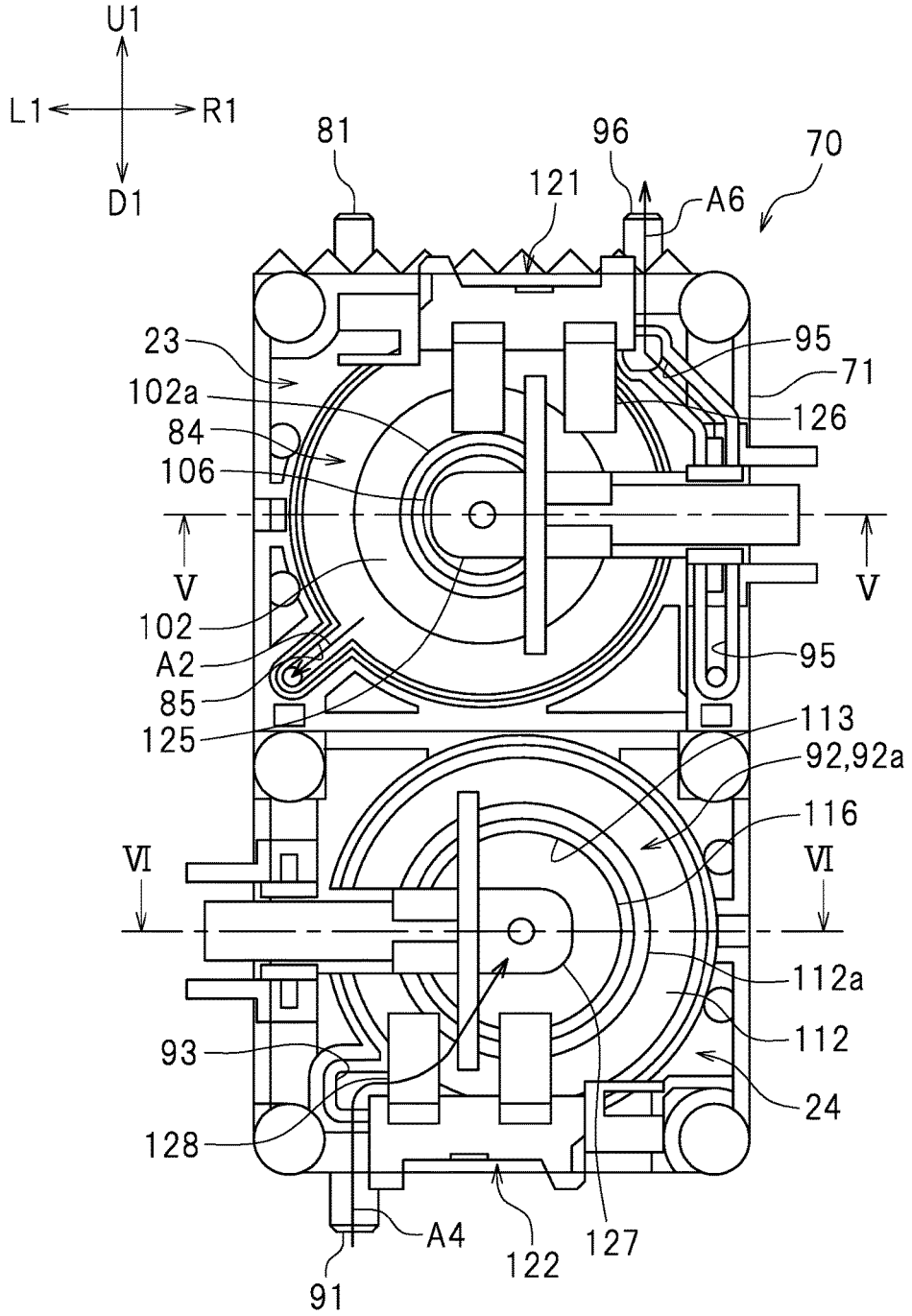
FIG. 3 is a front view illustrating a damper device.
Figure 4:
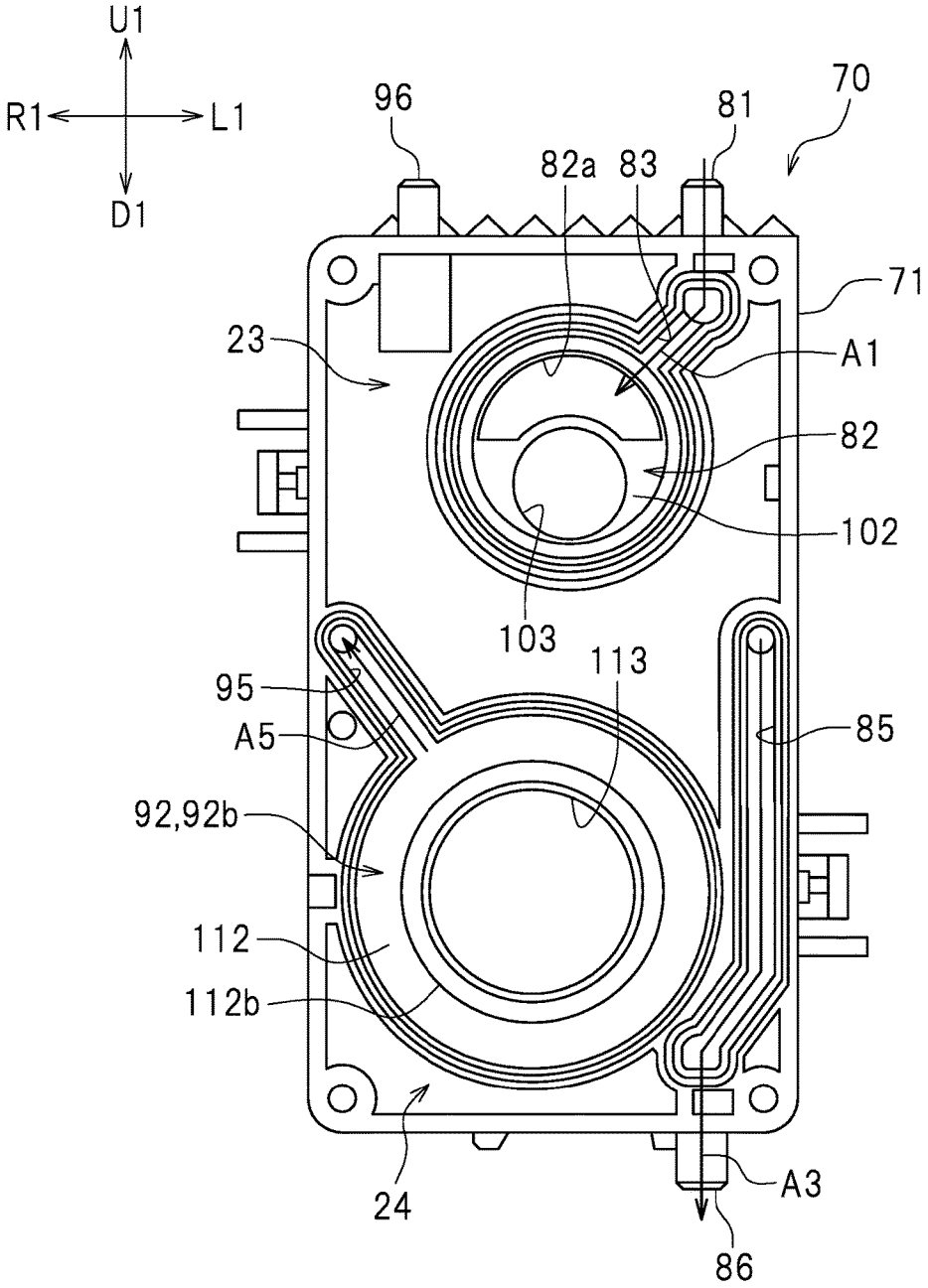
FIG. 4 is a rear view illustrating the damper device.
Figure 5:
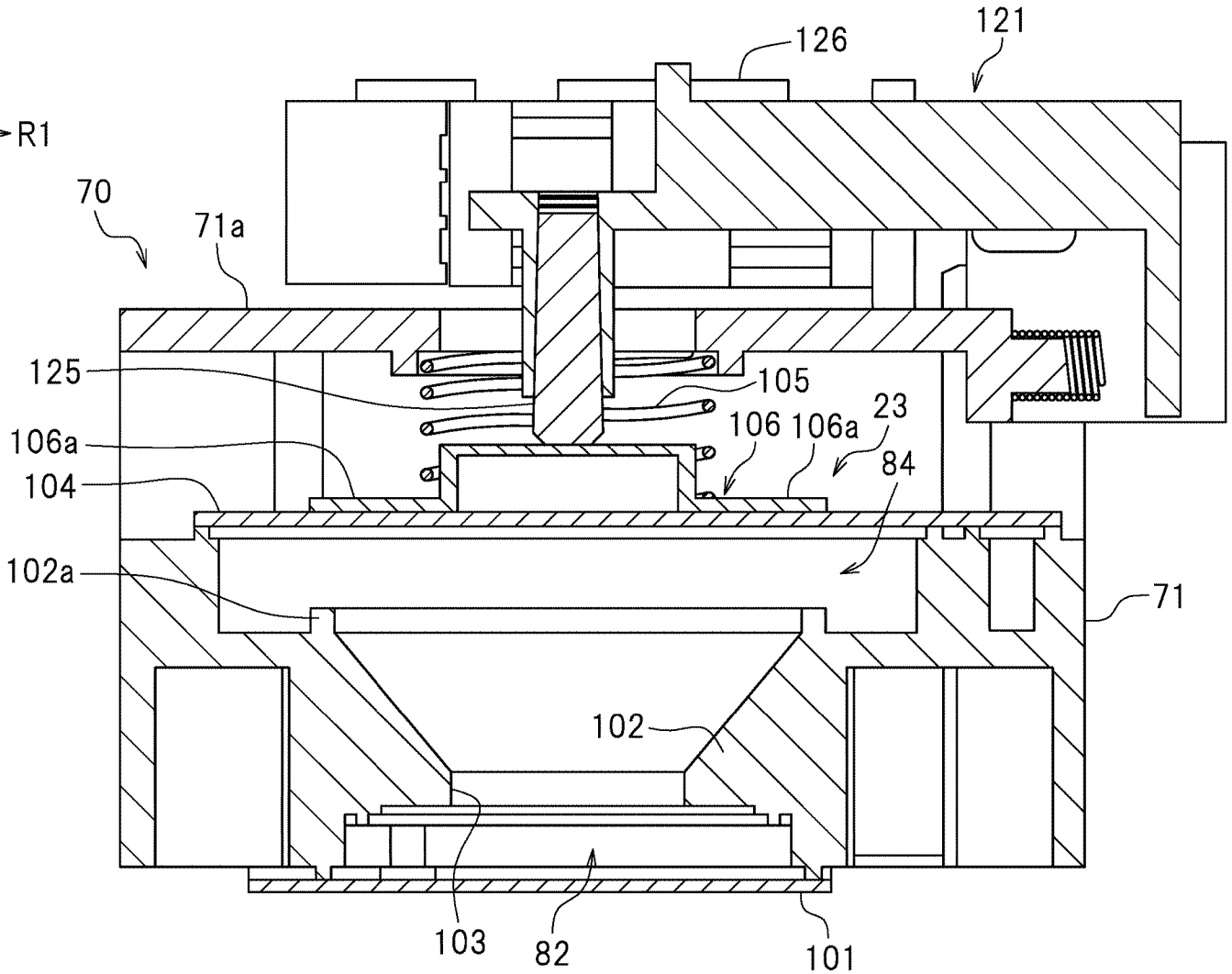
FIG. 5 is a cross-sectional view of the damper device, taken along line V-V in FIG. 3.
Figure 6:
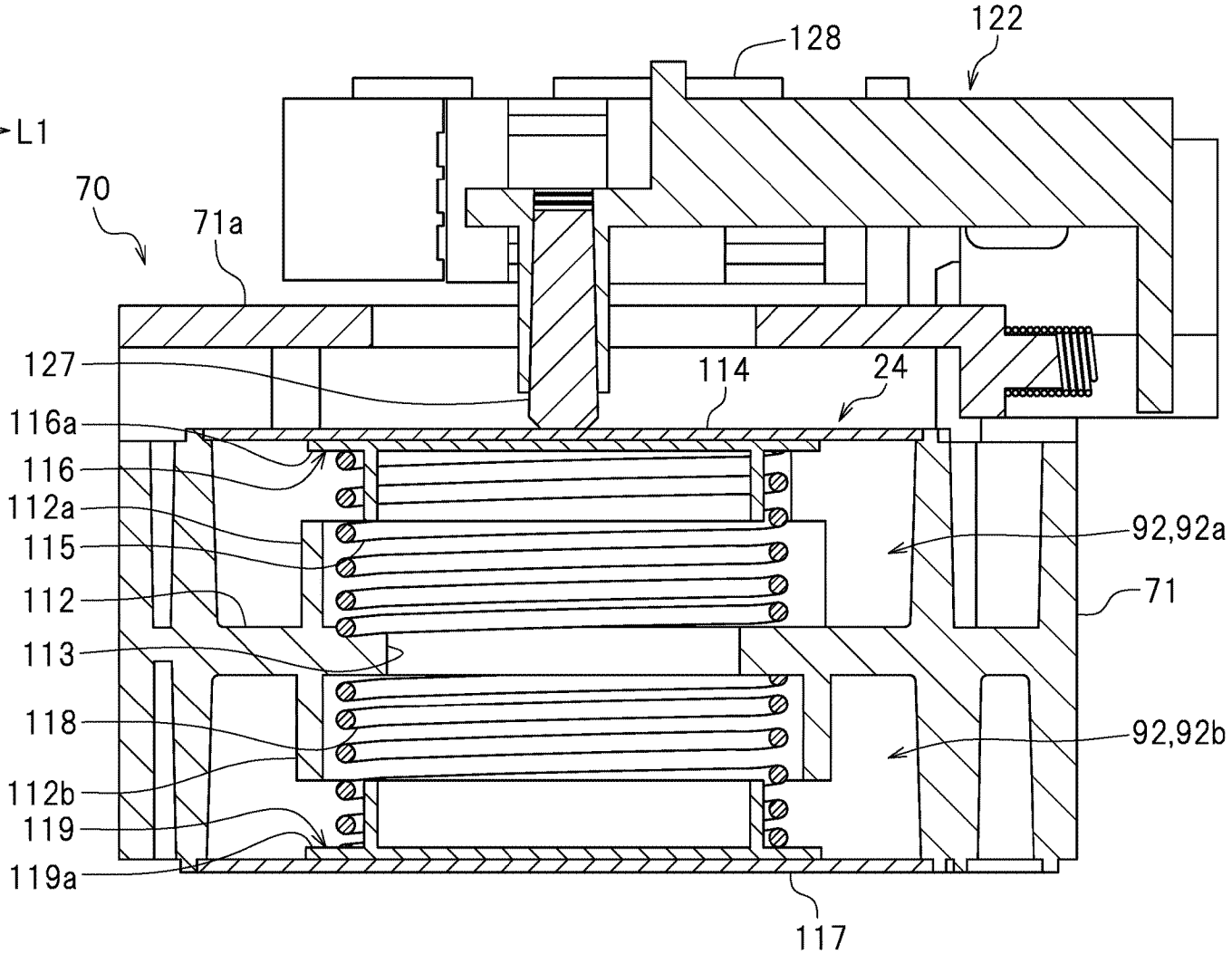
FIG. 6 is a cross-sectional view of the damper device, taken along line VI-VI in FIG. 3.

FIG. 3 is a front view of a damper device 70. FIG. 4 is a rear view of the damper device 70. FIG. 5 is a cross-sectional view of the damper device 70, taken along line V-V in FIG. 3. FIG. 6 is a cross-sectional view of the damper device 70, taken along line VI-VI in FIG. 3. In the present preferred embodiment, the upstream damper 23 and the downstream damper 24 are preferably defined by a single member, as illustrated in FIG. 3. Herein, the upstream damper 23 and the downstream damper 24 are collectively referred to as the damper device 70. Herein, the damper device 70 includes a damper main body 71, the upstream damper 23, and the downstream damper 24.

Figure 7:
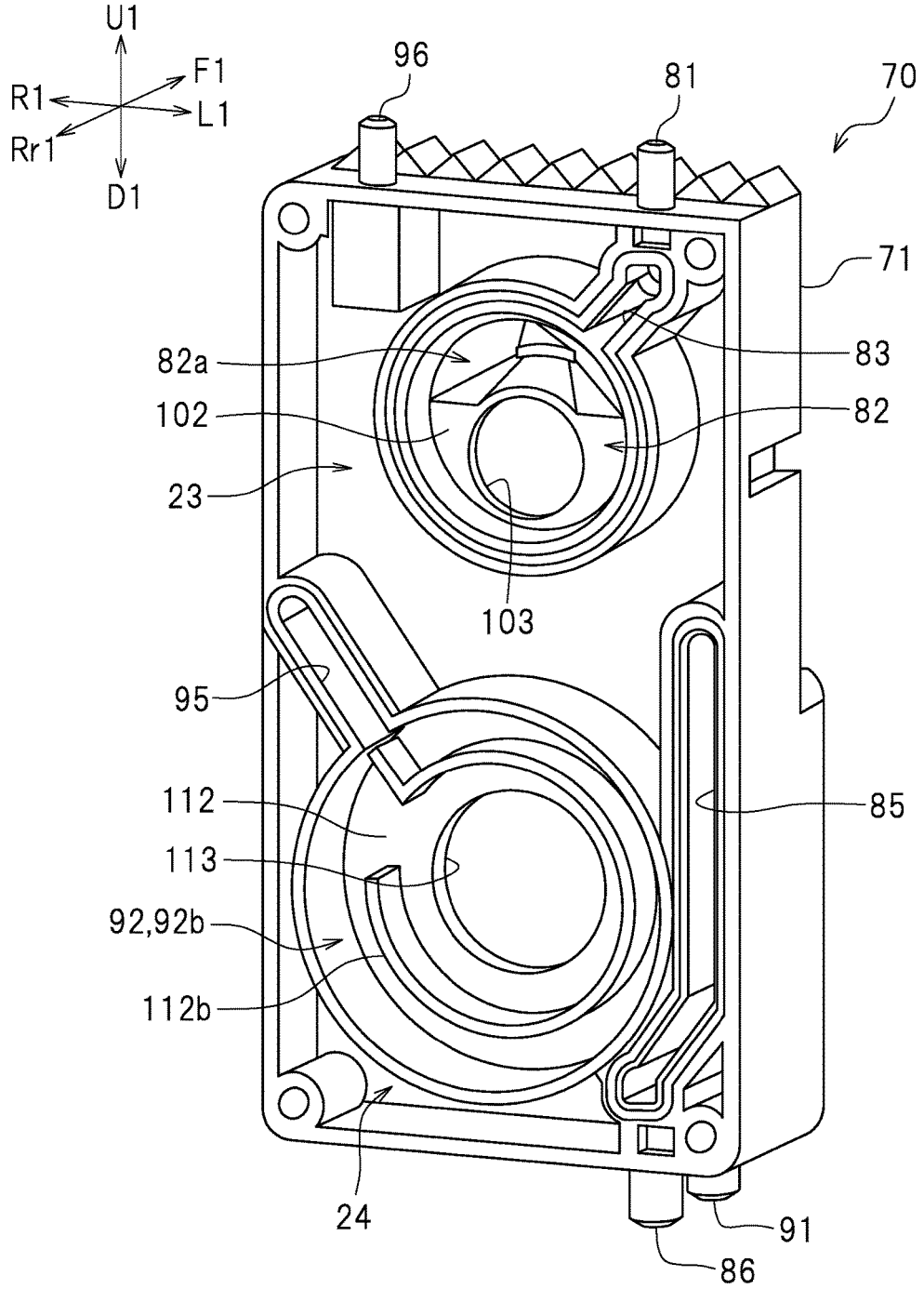
FIG. 7 is a perspective view illustrating a damper main body.
Figure 8:
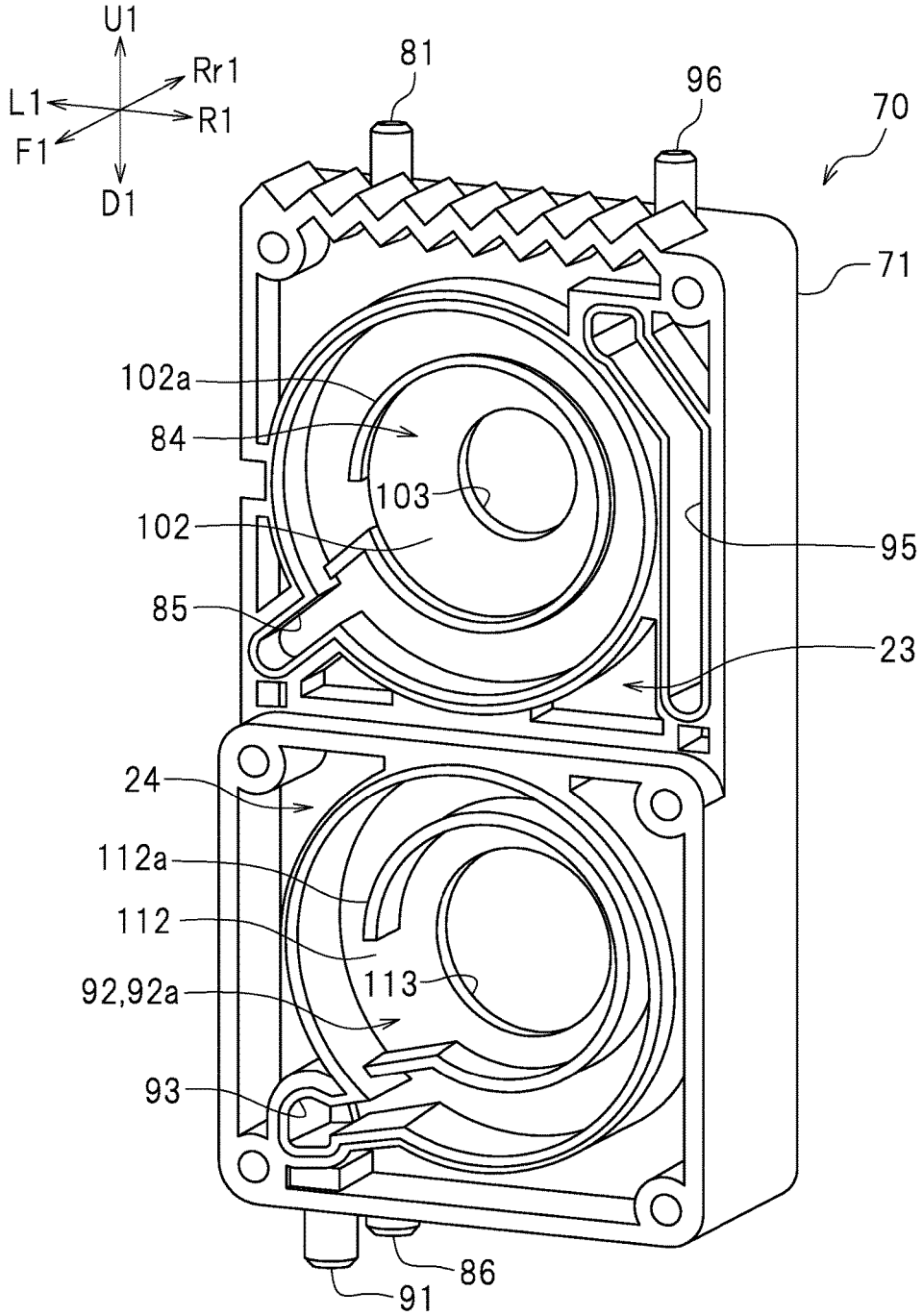
FIG. 8 is another perspective view illustrating the damper main body.

In the following description, the term "height" refers to a distance along the gravitational direction (i.e., the vertical direction) when the ink supply system 10 and the damper device 70 are arranged properly in a predetermined posture at a predetermined position. In the drawings depicting the damper device 70, reference characters F1, Rr1, L1, R1, U1, and D1 respectively represent front, rear, left, right, up, and down when the damper device 70 is viewed from the front. FIGS. 7 and 8 are perspective views of the damper main body 71. As illustrated in FIG. 7, the damper main body 71 is preferably rectangular or substantially rectangular in shape. The damper main body 71 is, for example, made of resin. The shape and material of the damper main body 71 are, however, not limited to a particular shape or a particular material. As illustrated in FIG. 5, a cover 71*a* is provided in front of the damper main body 71. Note that in FIG. 3, the cover 71*a* is not shown.

As illustrated in FIG. 7, the upstream damper 23 includes an upstream inflow port 81, a filter chamber 82, a first upstream flow channel 83, an upstream ink chamber 84 (see FIG. 8), a second upstream flow channel 85, and an upstream outflow port 86. In the present preferred embodiment, the upstream inflow port 81, the filter chamber 82, the first upstream flow channel 83, the upstream ink chamber 84, the second upstream flow channel 85, and the upstream outflow port 86 are provided in the damper main body 71.

The upstream inflow port 81 allows the ink flowing toward the ink head 11 to flow therethrough. In the present preferred embodiment, the upstream inflow port 81 is provided in a left portion of the upper surface of the damper main body 71. However, the position of the upstream inflow port 81 is not limited to a particular position. Herein, the upstream inflow port 81 is connected to the middle upstream section 15*c* (see FIG. 2) of the upstream flow channel 15. The ink flowing from the upstream pump 21 passes through the middle upstream section 15*c* and flows into the upstream inflow port 81.

As illustrated in FIG. 5, the filter chamber 82 removes impurities such as dregs contained in the ink flowing toward the ink head 11. In the present preferred embodiment, the filter chamber 82 is provided in an upper rear portion of the damper main body 71. The filter chamber 82 is substantially cylindrical in shape. In the present preferred embodiment, a recessed portion 82*a* that is recessed toward the upstream ink chamber 84 is provided in a portion of the filter chamber 82 that is closer to the upstream inflow port 81, as illustrated in FIG. 7. This recessed portion 82*a* collects impurities. Herein, as illustrated in FIG. 5, a filter membrane 101 is provided on an upper portion of the rear surface of the damper main body 71. A region surrounded by the damper main body 71 and the filter membrane 101 is the filter chamber 82. The filter membrane 101 is defined by a flexible resin film, for example.

As illustrated in FIG. 7, the first upstream flow channel 83 is a flow channel allowing the upstream inflow port 81 and the filter chamber 82 to communicate with each other. In other words, the first upstream flow channel 83 is a flow channel allowing the ink that has entered from the upstream inflow port 81 to flow into the filter chamber 82. The upstream end of the first upstream flow channel 83 is connected to the upstream inflow port 81. The downstream end of the first upstream flow channel 83 is connected to the filter chamber 82.

As illustrated in FIG. 5, the upstream ink chamber 84 stores ink temporarily. In the present preferred embodiment, the upstream ink chamber 84 is provided in an upper portion of the damper main body 71. The upstream ink chamber 84 is provided in front of the filter chamber 82. Herein, an upstream partition 102 is provided between the filter chamber 82 and the upstream ink chamber 84. This upstream partition 102 separates the filter chamber 82 and the upstream ink chamber 84 from each other. An upstream communication hole 103 is provided in the upstream partition 102. The filter chamber 82 and the upstream ink chamber 84 are allowed to communicate with each other through the upstream communication hole 103. In the present preferred embodiment, the upstream ink chamber 84 has a shape such that a substantially truncated conical-shaped space with its diameter gradually increasing from the upstream communication hole 103 toward the front is connected to a substantially cylindrical-shaped space. This serves to prevent ink from staying in the upstream ink chamber 84, and therefore, it is easy to supply fresh ink to the ink head 11.

In the present preferred embodiment, in the upstream ink chamber 84, an upstream guide protuberance 102*a* protruding frontward is provided on a surface of the upstream partition 102 that faces the upstream ink chamber 84, as illustrated in FIG. 8. The upstream guide protuberance 102*a* guides the flow of ink in the upstream ink chamber 84. The upstream guide protuberance 102*a* is, when viewed from the front, in a substantially ring shape, a portion of which is cut away, provided between the outer edge of the upstream communication hole 103 and a side surface of the upstream ink chamber 84. A portion of the upstream guide protuberance 102*a* extends toward the upstream end of the second upstream flow channel 85. This allows the ink within the upstream ink chamber 84 to flow therethrough while being guided by the upstream guide protuberance 102*a*. This serves to prevent ink from staying in the upstream ink chamber 84.

In the present preferred embodiment, an upstream damper membrane 104 is provided on an upper portion of the front surface of the damper main body 71, as illustrated in FIG. 5. Herein, a region surrounded by the damper main body 71 and the upstream damper membrane 104 is the upstream ink chamber 84. The upstream damper membrane 104 is defined by a flexible resin film. The upstream damper membrane 104 is able to deform inwardly and outwardly of the upstream ink chamber 84 according to the amount of ink stored in the upstream ink chamber 84. The upstream damper membrane 104 is fitted to the damper main body 71 with a tensile force such as to be able to bend inwardly and outwardly of the upstream ink chamber 84.

In the present preferred embodiment, an upstream spring 105 is provided in an upper portion of the damper main body 71 that is in front of the upstream ink chamber 84. The upstream spring 105 is, for example, a coil spring. The upstream spring 105 is provided between the cover 71*a* and the upstream damper membrane 104. The upstream spring 105 is kept in a compressed state, to exert an elastic force against the upstream damper membrane 104. In the present preferred embodiment, the upstream spring 105 supports an upstream pressing element 106. The upstream pressing element 106 is in contact with the upstream damper membrane 104, and the elastic force of the upstream spring 105 presses the upstream pressing element 106 against the upstream damper membrane 104. The upstream pressing element 106 is provided with a flange 106*a* so that the upstream damper membrane 104 is able to be pressed uniformly. The flange 106*a* is in contact with the upstream damper membrane 104. Herein, the upstream damper membrane 104 is pressed inwardly of the upstream ink chamber 84 (i.e., downward in FIG. 5). The volumetric capacity of the upstream ink chamber 84 is variable because the upstream spring 105 can expand and contract and the upstream damper membrane 104 can thereby bend.

As illustrated in FIGS. 7 and 8, the second upstream flow channel 85 is a flow channel allowing the upstream ink chamber 84 and the upstream outflow port 86 to communicate with each other. In other words, the second upstream flow channel 85 is a flow channel that allows the ink within the upstream ink chamber 84 to flow to the upstream outflow port 86. Herein, as illustrated in FIG. 8, the upstream end of the second upstream flow channel 85 is connected to the upstream ink chamber 84. As illustrated in FIG. 7, the downstream end of the second upstream flow channel 85 is connected to the upstream outflow port 86. In the present preferred embodiment, the second upstream flow channel 85 is disposed to the left of a downstream ink chamber 92.

The ink within the upstream ink chamber 84 flows out through the upstream outflow port 86 toward the ink head 11. In the present preferred embodiment, the upstream outflow port 86 is provided in a left portion of the bottom surface of the damper main body 71. However, the position of the upstream outflow port 86 is not limited to a particular position. Herein, the upstream outflow port 86 is connected to the second upstream section 15*b* (see FIG. 2) of the upstream flow channel 15. The ink within the upstream ink chamber 84 flows out from the upstream outflow port 86 to the second upstream section 15*b* and flows into the ink head 11.

As illustrated in FIG. 8, the downstream damper 24 includes a downstream inflow port 91, a downstream ink chamber 92, a first downstream flow channel 93, a second downstream flow channel 95, and a downstream outflow port 96. In the present preferred embodiment, the downstream inflow port 91, the downstream ink chamber 92, the first downstream flow channel 93, the second downstream flow channel 95, and the downstream outflow port 96 are provided in the damper main body 71.

The downstream inflow port 91 allows the ink that has flowed out of the ink head 11 to flow therethrough. In the present preferred embodiment, the downstream inflow port 91 is provided in a left portion of the bottom surface of the damper main body 71 that is frontward relative to the upstream outflow port 86. However, the position of the upstream inflow port 91 is not limited to a particular position. Herein, the downstream inflow port 91 is connected to the first downstream section 16*a* (see FIG. 2) of the downstream flow channel 16. The ink that has flowed out from the ink head 11 passes through the first downstream section 16*a* and flows into the downstream inflow port 91.

The downstream ink chamber 92 stores ink temporarily. The downstream ink chamber 92 is provided in a lower portion of the damper main body 71. Herein, the downstream ink chamber 92 is disposed below the filter chamber 82 and below the upstream ink chamber 84. In the present preferred embodiment, the downstream ink chamber 92 includes two ink chambers, a first downstream ink chamber 92*a* and a second downstream ink chamber 92*b*. However, the number of the ink chambers that define the downstream ink chamber 92 may be one, or three or more.

As illustrated in FIG. 8, the first downstream ink chamber 92*a* is provided in a lower front portion of the damper main body 71. In the present preferred embodiment, the first downstream ink chamber 92*a* is in a substantially cylindrical shape. Therefore, it is difficult for the ink to keep staying in the first downstream ink chamber 92*a*. Herein, as illustrated in FIG. 6, a first downstream damper membrane 114 is provided on a lower portion of the front surface of the damper main body 71. A region surrounded by the damper main body 71 and the first downstream damper membrane 114 is the first downstream ink chamber 92*a*. Like the upstream damper membrane 104, the first downstream damper membrane 114 is defined by a flexible resin film. The first downstream damper membrane 114 is able to deform inwardly and outwardly of the first downstream ink chamber 92*a* according to the amount of ink stored in the first downstream ink chamber 92*a*. The first downstream damper membrane 114 is affixed to an edge portion of the damper main body 71 with a tensile force such as to be able to bend inwardly and outwardly of the first downstream ink chamber 92*a*. In the present preferred embodiment, the first downstream damper membrane 114 is an example of the "downstream damper membrane".

In the present preferred embodiment, a first downstream spring 115 is provided in the first downstream ink chamber 92*a*. The first downstream spring 115 is, for example, a coil spring. The first downstream spring 115 exerts an elastic force against the first downstream damper membrane 114. For example, one end of the first downstream spring 115 is provided on a downstream partition wall 112. The first downstream spring 115 is kept in a compressed state. In addition, the first downstream spring 115 supports a first downstream pressing element 116. The first downstream pressing element 116 is in contact with the first downstream damper membrane 114, and the elastic force of the first downstream spring 115 presses the first downstream pressing element 116 against the first downstream damper membrane 114. The first downstream pressing element 116 is provided with a flange 116*a* so that the first downstream damper membrane 114 can be pressed uniformly. The flange 116*a* is in contact with the first downstream damper membrane 114. Herein, the first downstream damper membrane 114 is pressed outwardly of the first downstream ink chamber 92*a* (i.e., upward in FIG. 6). The volumetric capacity of the first downstream ink chamber 92*a* is variable because the first downstream spring 115 can expand and contract and the downstream damper membrane 114 can thereby bend.

As illustrated in FIG. 7, the second downstream ink chamber 92*b* is provided in a lower rear portion of the damper main body 71. The second downstream ink chamber 92*b* is provided behind the first downstream ink chamber 92*a*. In the present preferred embodiment, the downstream partition wall 112 is provided between the first downstream ink chamber 92*a* and the second downstream ink chamber 92*b*. The downstream partition wall 112 separates the first downstream ink chamber 92*a* and the second downstream ink chamber 92*b* from each other. A downstream communication hole 113 is provided in the upstream partition 112. The first downstream ink chamber 92*a* and the second downstream ink chamber 92*b* are allowed to communicate with each other through the downstream communication hole 113. In the present preferred embodiment, the second downstream ink chamber 92*b* is in a substantially cylindrical shape. Therefore, it is difficult for the ink to keep staying in the second downstream ink chamber 92*b*.

In the present preferred embodiment, a portion of the inner circumferential surface of the first downstream ink chamber 92*a* is defined by the downstream partition wall 112, as illustrated in FIG. 8. A first guide protuberance 112*a* protruding frontward is provided on a surface of the downstream partition wall 112 that faces the first downstream ink chamber 92*a*. The first guide protuberance 112*a* guides the flow of ink in the first downstream ink chamber 92*a*. The first guide protuberance 112*a* is, when viewed from the front, in a substantially ring shape, a portion of which is cut away, provided between the outer edge of the downstream communication hole 113 and a side surface of the first downstream ink chamber 92*a*. A portion of the first guide protuberance 112*a* extends toward the first downstream flow channel 93. This allows the ink within the first downstream ink chamber 92*a* to flow therethrough while being guided by the first guide protuberance 112*a*. Therefore, it is difficult for the ink to stay in the first downstream ink chamber 92*a*.

In the present preferred embodiment, a portion of the inner circumferential surface of the second downstream ink chamber 92*b* is defined by the downstream partition wall 112, as illustrated in FIG. 7. A second guide protuberance 112*b* protruding rearward is provided on a surface of the downstream partition wall 112 that faces the second downstream ink chamber 92*b*. The second guide protuberance 112*b* guides the flow of ink in the second downstream ink chamber 92*b*. The second guide protuberance 112*b* is, when viewed from the front, in a substantially ring shape, a portion of which is cut away, provided between the outer edge of the downstream communication hole 113 and a side surface of the second downstream ink chamber 92*b*. A portion of the second guide protuberance 112*b* extends toward the second downstream flow channel 95. This allows the ink within the second downstream ink chamber 92*b* to flow therethrough while being guided by the second guide protuberance 112*b*. Therefore, it is difficult for the ink to stay in the second downstream ink chamber 92*b*.

In the present preferred embodiment, a second downstream damper membrane 117 is provided on a lower portion of the rear surface of the damper main body 71, as illustrated in FIG. 6. A region surrounded by the damper main body 71 and the second downstream damper membrane 117 is the second downstream ink chamber 92*b*. Like the first downstream damper membrane 114, the second downstream damper membrane 117 is defined by a flexible resin film. The second downstream damper membrane 117 is able to deform inwardly and outwardly of the second downstream ink chamber 92*b* according to the amount of ink stored in the second downstream ink chamber 92*b*. The second downstream damper membrane 117 is affixed to an edge portion of the damper main body 71 with a tensile force such as to be able to bend inwardly and outwardly of the second downstream ink chamber 92*b*.

In the present preferred embodiment, a second downstream spring 118 is provided in the second downstream ink chamber 92*b*. The second downstream spring 118 is, for example, a coil spring. The second downstream spring 118 exerts an elastic force against the second downstream damper membrane 117. Herein, one end of the second downstream spring 118 is provided on the downstream partition wall 112. The second downstream spring 118 is kept in a compressed state. In the present preferred embodiment, the second downstream spring 118 supports a second downstream pressing element 119. The second downstream pressing element 119 is in contact with the second downstream damper membrane 117, and the elastic force of the second downstream spring 118 presses the second downstream pressing element 119 against the second downstream damper membrane 117. Herein, the second downstream pressing element 119 is provided with a flange 119*a* so that the second downstream damper membrane 117 can be pressed uniformly. The flange 119*a* is in contact with the second downstream damper membrane 117. The second downstream damper membrane 117 is pressed outwardly of the second downstream ink chamber 92*b* (i.e., downward in FIG. 6). The volumetric capacity of the second downstream ink chamber 92*b* is variable because the second downstream spring 118 can expand and contract and the downstream damper membrane 117 can thereby bend.

As illustrated in FIG. 8, the first downstream flow channel 93 is a flow channel allowing the downstream inflow port 91 and the downstream ink chamber 92 to communicate with each other. The first downstream flow channel 93 is a flow channel allowing the ink that has entered from the downstream inflow port 91 to flow into the downstream ink chamber 92. In the present preferred embodiment, the upstream end of the first downstream flow channel 93 is connected to the downstream inflow port 91. The downstream end of the first downstream flow channel 93 is connected to the downstream ink chamber 92. More specifically, the downstream end of the first downstream flow channel 93 is connected to the first downstream ink chamber 92*a*.

As illustrated in FIGS. 7 and 8, the second downstream flow channel 95 is a flow channel allowing the downstream ink chamber 92 and the downstream outflow port 96 to communicate with each other. The second downstream flow channel 95 is a flow channel that allows the ink within the downstream ink chamber 92 to flow to the upstream outflow port 96. Herein, as illustrated in FIG. 7, the upstream end of the second downstream flow channel 95 is connected to the downstream ink chamber 92. More specifically, the upstream end of the second downstream flow channel 95 is connected to the second downstream ink chamber 92*b*. As illustrated in FIG. 8, the downstream end of the second downstream flow channel 95 is connected to the downstream outflow port 96.

The ink within the downstream ink chamber 92 (more specifically, the second downstream ink chamber 92*b*) flows out through the downstream outflow port 96. In the present preferred embodiment, the downstream outflow port 96 is provided in a right portion of the upper surface of the damper main body 71. However, the position of the downstream outflow port 96 is not limited to a particular position. Herein, the downstream outflow port 96 is connected to the middle downstream section 16*c* (see FIG. 2) of the downstream flow channel 16. The ink within the second downstream ink chamber 92*b* passes through the second downstream flow channel 95 and flows out from the downstream outflow port 96 to the middle downstream section 16*c*.

In the present preferred embodiment, as illustrated in FIG. 3, the damper device 70 includes an upstream detector 121 that detects the amount of ink stored in the upstream ink chamber 84 of the upstream damper 23, and a downstream detector 122 that detects the amount of ink stored in the downstream ink chamber 92 of the downstream damper 24. In the present preferred embodiment, the upstream detector 121 detects whether or not the amount of ink within the upstream ink chamber 84 is equal to or less than a predetermined first capacity. It should be noted that the configuration of the upstream detector 121 is not limited to a particular configuration. In the present preferred embodiment, as illustrated in FIG. 5, the upstream detector 121 detects the amount of ink stored in the upstream ink chamber 84 from a change in position of the upstream damper membrane 104 of the upstream damper 23. Herein, the upstream detector 121 includes an upstream filler 125, which is in contact with the upstream pressing element 106, and an upstream detection sensor 126 (see FIG. 3).

The upstream filler 125 is provided in an upper portion of the cover 71*a* attached to the damper main body 71. The upstream filler 125 is in contact with the upstream pressing element 106. The upstream filler 125 is movable in association with bending of the upstream damper membrane 104. The upstream detection sensor 126 may be, for example, a photosensor. The upstream detection sensor 126 detects bending of the upstream damper membrane 104 by optically detecting the position of the upstream filler 125. For example, when the amount of ink within the upstream ink chamber 84 decreases, the upstream damper membrane 104 bends inwardly of the upstream ink chamber 84, and accordingly, the upstream filler 125 moves inwardly of the upstream ink chamber 84 (i.e., downward in FIG. 5). At that time, by detecting the position of the upstream filler 125, the upstream detection sensor 126 detects whether or not the amount of ink in the upstream ink chamber 84 is equal to or less than a predetermined first capacity. Note that in the present preferred embodiment, if it is detected that the amount of ink in the upstream ink chamber 84 is equal to or less than the predetermined first capacity, actuation of the upstream pump 21 is controlled so that the ink flow rate is increased by the upstream pump 21.

In the present preferred embodiment, as illustrated in FIG. 3, the downstream detector 122 detects the amount of ink stored in the downstream ink chamber 92 by detecting the amount of ink stored in the first downstream ink chamber 92*a* of the downstream ink chamber 92. However, the downstream detector 122 may be structured to detect the amount of ink stored in the downstream ink chamber 92 by detecting the amount of ink stored in the second downstream ink chamber 92*b* of the downstream ink chamber 92. In the present preferred embodiment, the downstream detector 122 detects whether or not the amount of ink within the first downstream ink chamber 92*a* is equal to or less than a predetermined second capacity. The configuration of the downstream detector 122 is not limited to a particular configuration. In the present preferred embodiment, as illustrated in FIG. 6, the upstream detector 122 detects the amount of ink stored in the first downstream ink chamber 92*a* from a change in position of the downstream damper membrane 114 of the downstream damper 24. Herein, the downstream detector 122 includes a downstream filler 127, which is in contact with the first downstream pressing element 116 via the first downstream damper membrane 114, and a downstream detection sensor 128 (see FIG. 3).

The downstream filler 127 is provided in a lower portion of the cover 71*a* attached to the damper main body 71. The downstream filler 127 is movable in association with bending of the first downstream damper membrane 114. The downstream detection sensor 128 may be, for example, a photosensor, like the upstream detection sensor 126. The downstream detection sensor 128 detects bending of the first downstream damper membrane 114 by optically detecting the position of the downstream filler 127. For example, when the amount of ink within the first downstream ink chamber 92*a* decreases, the first downstream damper membrane 114 bends inwardly of the first downstream ink chamber 92*a*, and accordingly, the downstream filler 127 moves inwardly of the first downstream ink chamber 92*a* (i.e., downward in FIG. 6). At that time, by detecting the position of the downstream filler 127, the downstream detection sensor 128 detects whether or not the amount of ink in the first downstream ink chamber 92*a* is equal to or less than a predetermined second capacity. Note that in the present preferred embodiment, if it is detected that the amount of ink in the first downstream ink chamber 92*a* is equal to or less than the predetermined second capacity, actuation of the downstream pump 22 is controlled so that the ink flow rate is increased by the downstream pump 22.

Figure 9:
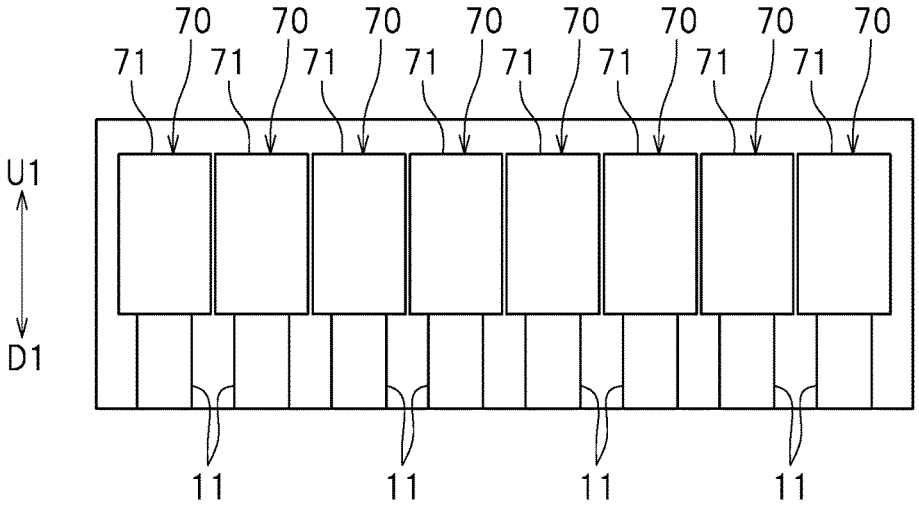
FIG. 9 is a view illustrating the positional relationship between damper devices and ink heads.

FIG. 9 is a view illustrating the positional relationship between damper devices 70 and ink heads 11. In the present preferred embodiment, the damper devices 70 are provided above the ink heads 11, as illustrated in FIG. 9. The upstream dampers 23, the downstream dampers 24, and the damper main bodies 71 are disposed above the ink heads 11. Herein, the damper devices 70 (the upstream dampers 23, the downstream dampers 24, and the damper main bodies 71) are mounted on the carriage 4. As the carriage 4 moves in a leftward or rightward direction, the damper devices 70 accordingly move in a leftward or rightward direction along with the ink heads 11. Herein, the relative positions of the damper devices 70 (the upstream dampers 23, the downstream dampers 24, and the damper main bodies 71) with the ink heads 11 do not change. In the present preferred embodiment, the filter chamber 82 and the upstream ink chamber 84 of the upstream damper 23 are disposed at the same height level, as illustrated in FIGS. 7 and 8. The first downstream ink chamber 92*a* and the second downstream ink chamber 92*b* of the downstream damper 24 are disposed at the same height level. Herein, the filter chamber 82 and the upstream ink chamber 84 are disposed at higher positions than the first downstream ink chamber 92*a* and the second downstream ink chamber 92*b*.

Note that as illustrated in FIG. 2, the upstream damper 23 may be provided with a thermistor 32 that detects the temperature of the ink in the upstream flow channel 15.

Next, the air trap 25 will be described below. The air trap 25 is a device that collects the air contained in the ink supply system 10 and discharges the collected air out of the ink flow channel 20. The air trap 25 is provided in the connection flow channel 14. More specifically, the air trap 25 is provided between the first connection section 14*a* and the second connection section 14*b* in the connection flow channel 14. The air trap 25 includes, for example, an ink pouch 33 that is able to store ink and the air contained in the ink, and a discharge mechanism 34 that discharges the air contained in the ink pouch 33 out of the ink pouch 33. Note that herein, the phrase "the air trap 25 is stopped" means a state in which the air inside the air trap 25 is not discharged and the air is stored in the air trap 25. The phrase "the air trap 25 is actuated" means a state in which the air stored in the air trap 25 is being discharged.

It should be noted that in the present preferred embodiment, the air trap 25 may also include a thermistor 35*a* and a heater 35*b*. The thermistor 35*a* detects the temperature of the ink within the ink pouch 33 of the air trap 25. The heater 35*b* heats the ink within the ink pouch 33 of the air trap 25.

The inlet valve 26 is a valve that opens and closes the inlet flow channel 13. The inlet valve 26 opens the inlet flow channel 13 to thereby permit the ink stored in the ink tank 12 to be supplied to the ink head 11. The inlet valve 26 closes the inlet flow channel 13 to thereby prohibit the ink stored in the ink tank 12 from flowing to the ink head 11. In the present preferred embodiment, the term "open" may mean to include, for example, cases in which the flow channel to be opened and closed is not completely opened but a portion of the flow channel is opened, in addition to a case in which the flow channel to be opened and closed is completely opened. When the condition in which the flow channel to be opened and closed is completely opened is taken as 100%, the term "open" may mean to include, for example, an approximately 80% open state, or an approximately 90% open state. Depending on the configuration of the ink supply system 10, it is possible that the term "open" may mean to include, for example, an approximately 10% open state. In the present preferred embodiment, it is preferable that the term "closed" mean that the flow channel to be opened and closed is completely closed. That said, depending on the configuration of the ink supply system 10, it is also possible that the term "closed" may mean to include a state in which a very small portion of the flow channel to be opened and closed is opened. When the state in which the flow channel to be opened and closed is completely opened is taken as 100%, it is possible that the term "closed" may mean to include, for example, an approximately 1% open state, depending on the configuration of the ink supply system 10. In the present preferred embodiment, the inlet valve 26 is provided in the inlet flow channel 13. More specifically, the inlet valve 26 is provided between the first inlet section 13*a* and the second inlet section 13*b* of the inlet flow channel 13. Although the type of the inlet valve 26 is not limited to a particular type of valve, the inlet valve 26 herein is a choke valve.

The outlet valve 27 is a valve that opens and closes the outlet flow channel 17. The outlet valve 27 opens the outlet flow channel 17 to thereby permit the ink within the ink flow channel 20 to be discharged out of the ink flow channel 20. The outlet valve 27 closes the outlet flow channel 17 to thereby prohibit the ink within the ink flow channel 20 from being discharged out of the ink flow channel 20. In the present preferred embodiment, the outlet valve 27 is provided in the outlet flow channel 17. More specifically, the outlet valve 27 is provided between the first outlet section 17*a* and the middle outlet section 17*c* of the outlet flow channel 17. Note that the type of the outlet valve 27 is not limited to a particular type. In the present preferred embodiment, the outlet valve 27 is a choke valve, like the inlet valve 26. The outlet valve 27 may be the same type of valve as the inlet valve 26, or may be a different type of valve from the inlet valve 26.

The outlet pump 28 causes the ink, the air contained in the ink, or the like within the ink flow channel 20 to flow to the waste ink tank 29 in a condition in which the outlet flow channel 17 is opened by the outlet valve 27. The outlet pump 28 is provided in the outlet flow channel 17. More specifically, the outlet pump 28 is provided at a portion of the outlet flow channel 17 that is closer to the waste ink tank 29 than is the outlet valve 27. In the present preferred embodiment, the outlet pump 28 is provided between the middle outlet section 17*c* and the second outlet section 17*b* of the outlet flow channel 17. Although the type of the outlet pump 28 is not limited to a particular type, the outlet pump 28 herein is a tube pump. Although not shown in the drawings, the outlet pump 28 is connected to a motor. By actuating the motor, the outlet pump 28 is actuated.

Figure 10:
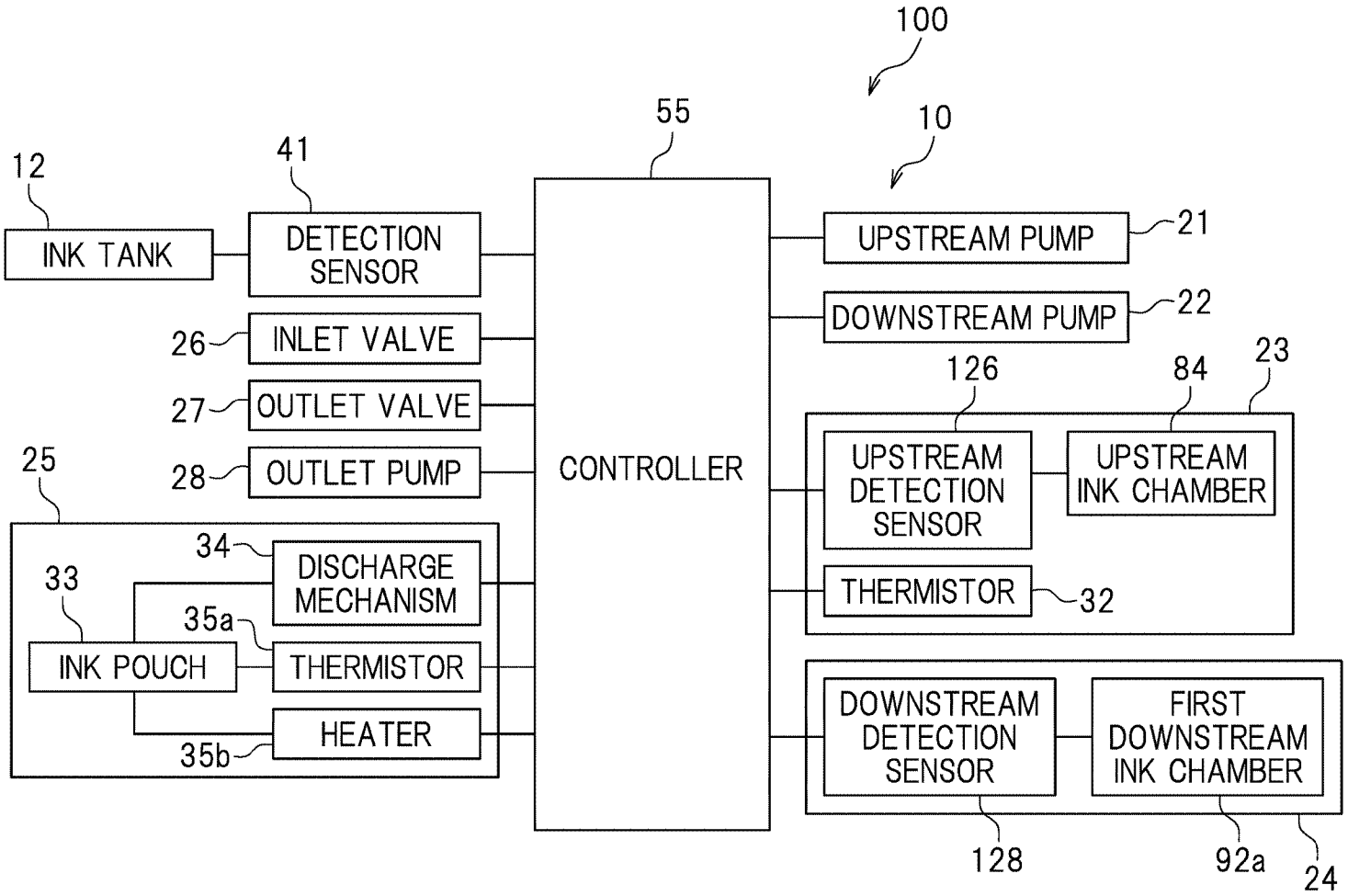
FIG. 10 is a block diagram illustrating the printer.

FIG. 10 is a block diagram of the printer 100. In the present preferred embodiment, the inkjet printer 10 includes a controller 55, as illustrated in FIG. 10. The controller 55 is a device that controls the ink supply systems 10. Herein, the controller 55 is a device that performs, for example, control of ink supply to the ink heads 11. The configuration of the controller 55 is not limited to a particular configuration. For example, the controller 55 may be a computer, and may include a central processing unit (hereinafter also referred to as "CPU"), a ROM that stores programs or the like to be executed by the CPU, and a RAM.

The controller 55 is connected to the detection sensor 41 provided in the ink tank 12, and with the detection sensor 41, the controller 55 detects the amount of ink stored in the ink tank 12. The controller 55 is connected to the upstream pump 21 and to the upstream detection sensor 126 of the upstream damper 23. The upstream detection sensor 126 of the upstream damper 23 detects the amount of ink stored in the upstream ink chamber 84, and based on the detection result, the controller 55 controls actuation of the upstream pump 21. The controller 55 is also connected to the downstream pump 22 and to the downstream detection sensor 128 of the downstream damper 24. The downstream detection sensor 128 of the downstream damper 24 detects the amount of ink stored in the first downstream ink chamber 92*a*, and based on the detection result, the controller 55 controls actuation of the downstream pump 22.

The controller 55 is connected to the thermistor 32 provided on the upstream damper 23. The controller 55 detects the temperature of the ink within the upstream flow channel 15 via the thermistor 32. The controller 55 is connected to the discharge mechanism 34 of the air trap 25. When the air in the ink pouch 33 should be discharged, the controller 55 controls the discharge mechanism 34 so as to discharge the air. The controller 55 is connected to the thermistor 35*a* provided on the air trap 25. The controller 55 detects the temperature of the ink within the ink pouch 33 of the air trap 25 via the thermistor 35*a*. The controller 55 is connected to the heater 35*b* provided in the air trap 25. The controller 55 controls the heater 35*b* so as to heat the ink within the ink pouch 33. The controller 55 is connected to the inlet valve 26. The controller 55 controls opening and closing of the inlet flow channel 13 by controlling the inlet valve 26. The controller 55 is connected to the outlet valve 27. The controller 55 controls opening and closing of the outlet flow channel 17 by controlling the outlet valve 27. The controller 55 is connected to the outlet pump 28. The controller 55 causes the ink within the ink flow channel 20 to be drained into the waste ink tank 29 by controlling the outlet pump 28.

Hereinabove, the configuration of the printer 100 including the ink supply system 10 according to the present preferred embodiment has been described. Next, operation of the ink supply system 10 at the time of printing will be described. When printing, ink is ejected from the nozzle 11*a* of the ink head 11 toward the recording medium 5 placed on the platen 7. When printing, the ink stored in the ink tank 12 is supplied to the ink head 11. At this time, the controller 55 opens the inlet valve 26 and also closes the outlet valve 27. Thus, the inlet flow channel 13 is brought into an opened state, while the outlet flow channel 17 is brought into a closed state. Also, when printing, the controller 55 actuates the upstream pump 21 and the downstream pump 22. More specifically, the controller 55 controls actuation of the upstream pump 21 and the downstream pump 22 so that the pressure in the ink head 11 is brought to a negative pressure. This enables the nozzle 11*a* of the ink head 11 to eject ink. It should be noted that, during printing, the air trap 25 is stopped, and the outlet pump 28 is also stopped.

In the present preferred embodiment, when printing, because the inlet valve 26 is opened, the ink stored in the ink tank 12 is allowed to pass through the inlet flow channel 13 and flow into the connection flow channel 14. Meanwhile, because the outlet valve 27 is closed and also the upstream pump 21 and the downstream pump 22 are actuated, the ink in the connection flow channel 14 is not allowed to flow into the outlet flow channel 17 but is allowed to flow into the upstream flow channel 15. Then, by actuation of the upstream pump 21, the ink in the upstream flow channel 15 is supplied to the ink head 11. Because the ink head 11 is in a negative pressure state, a portion of the ink within the ink head 11 is ejected from the nozzle 11*a* toward the recording medium 5, and a portion of the remaining ink within the ink head 11 is caused to flow into the downstream flow channel 16 by actuation of the downstream pump 22. Then, the ink within the downstream flow channel 16 flows into the connection flow channel 14. Thus, at the time of printing, ink passes through the connection flow channel 14, the upstream flow channel 15, the ink head 11, and the downstream flow channel 16, to circulate through the ink flow channel 20.

Next, operations of the upstream pump 21, the downstream pump 22, and the damper device 70 (the upstream damper 23 and the downstream damper 24) at the time of printing will be described. As illustrated in FIG. 2, when printing, the controller 55 controls actuation of the upstream pump 21 and the downstream pump 22 so that the pressure in the ink head 11 is brought to a negative pressure, in order to enable the nozzle 11*a* of the ink head 11 to eject ink toward the recording medium 5.

For example, when the upstream pump 21 is actuated, the ink within the middle upstream section 15*c* of the upstream flow channel 15 flows into the upstream damper 23 through the upstream inflow port 81, as illustrated in FIG. 4. The ink that has entered from the upstream inflow port 81 passes through the first upstream flow channel 83 and flows into the filter chamber 82, as indicated by arrow A1. Then, impurities contained in the ink are removed at the filter chamber 82, and the ink flows into the upstream ink chamber 84 through the upstream communication hole 103, which is provided in the upstream partition 102. At that time, as illustrated in FIG. 5, if the amount of the ink flowing into the upstream ink chamber 84 is less than the amount of the ink flowing out from the upstream ink chamber 84, the amount of the ink within the upstream ink chamber 84 decreases, so the upstream damper membrane 104 bends inward of the upstream ink chamber 84. At this time, the upstream filler 125 moves inward of the upstream ink chamber 84. Then, if, by detecting the position of the upstream filler 125 via the upstream detection sensor 126, it is detected that the amount of ink in the upstream ink chamber 84 is equal to or less than the predetermined first capacity, the controller 55 controls actuation of the upstream pump 21 so that the upstream pump 21 increases the flow rate of the flowing ink.

Then, if the amount of the ink flowing into the upstream ink chamber 84 becomes greater than the amount of the ink flowing out of the upstream ink chamber 84, the amount of the ink within the upstream ink chamber 84 increases, so the upstream damper membrane 104 bends outward of the upstream ink chamber 84. At this time, the upstream filler 125 moves outward of the upstream ink chamber 84. Then, if, by detecting the position of the upstream filler 125 via the upstream detection sensor 126, it is detected that the amount of ink in the upstream ink chamber 84 is equal to or less than the predetermined first capacity, the controller 55 controls actuation of the upstream pump 21 so that the upstream pump 21 decreases the flow rate of the flowing ink. Note that the ink flowing out from the upstream ink chamber 84 passes through the second upstream flow channel 85 and flows out from the upstream outflow port 86, as indicated by arrow A2 in FIG. 3 and arrow A3 in FIG. 4. Then, as illustrated in FIG. 2, the ink that has flowed out from the upstream outflow port 86 passes through the second upstream section 15*b* of the upstream flow channel 15 and flows into the ink head 11.

When the downstream pump 22 is actuated, a portion of the ink within the ink head 11 passes through the first downstream section 16*a* of the downstream flow channel 16 and flows into the downstream damper 24 through the downstream inflow port 91. The ink that has entered through the upstream inflow port 91 passes through the first downstream flow channel 93 and flows into the downstream ink chamber 92, as indicated by arrow A4 in FIG. 3. More specifically, the ink that has entered through the upstream inflow port 91 flows into the first downstream ink chamber 92*a* of the downstream ink chamber 92. Then, the ink within the first downstream ink chamber 92*a* flows into the second downstream ink chamber 92*b* through the downstream communication hole 113 located in the downstream partition wall 112. As illustrated in FIG. 6, if the amount of the ink flowing into the downstream ink chamber 92 is less than the amount of the ink flowing out from the downstream ink chamber 92, the amount of the ink within the downstream ink chamber 92 decreases. At this time, the decrease in the amount of the ink within the second downstream ink chamber 92*b* causes the second downstream damper membrane 117 to bend inward of the second downstream ink chamber 92*b*. Also, the decrease in the amount of the ink within the first downstream ink chamber 92*a* causes the first downstream damper membrane 114 to bend inward of the first downstream ink chamber 92*a*. At this time, the upstream filler 127 moves inward of the first downstream ink chamber 92*a*. Then, if, by detecting the position of the downstream filler 127 via the upstream detection sensor 128, it is detected that the amount of ink within the first downstream ink chamber 92*a* is equal to or less than the predetermined second capacity, the controller 55 controls actuation of the downstream pump 22 so that the downstream pump 22 increases the flow rate of the flowing ink.

Then, if the amount of the ink flowing into the downstream ink chamber 92 becomes greater than the amount of the ink flowing out from the downstream ink chamber 92, the amount of the ink within the downstream ink chamber 92 increases. At this time, the increase in the amount of the ink within the second downstream ink chamber 92*b* causes the second downstream damper membrane 117 to bend outward of the second downstream ink chamber 92*b*. Also, the increase in the amount of the ink within the first downstream ink chamber 92*a* causes the first downstream damper membrane 114 to bend outward of the first downstream ink chamber 92*a*. At this time, the downstream filler 127 moves outward of the first downstream ink chamber 92*a*. Then, if the downstream detection sensor 128 detects that the amount of ink within the first downstream ink chamber 92*a* is greater than the predetermined second capacity, the controller 55 controls actuation of the downstream pump 22 so that the downstream pump 22 decreases the flow rate of the flowing ink. Note that the ink flowing out of the second downstream ink chamber 92*b* of the downstream ink chamber 92 passes through the second downstream flow channel 95 and flows out from the downstream outflow port 96, as indicated by arrow A5 in FIG. 4 and arrow A6 in FIG. 3. Then, as illustrated in FIG. 2, the ink that has flowed out from the downstream outflow port 96 passes through the middle downstream section 16*c* of the downstream flow channel 16 and flows toward the downstream pump 22.

As has been described above, in the present preferred embodiment, the upstream damper 23 is provided in the upstream flow channel 15, which is upstream of the ink head 11, and the downstream damper 24 is provided in the downstream flow channel 16, which is downstream of the ink head 11. As a result, it is possible to reduce pressure fluctuations in the flow channels that are upstream and downstream of the ink head 11, based on the amount of ink stored in the upstream ink chamber 84, which is detected by the upstream detector 121, and the amount of ink stored in the downstream ink chamber 92, which is detected by the downstream detector 122. Therefore, it is easy to keep the pressure in the ink head 11 at a negative pressure, thus enabling the ink head 11 to eject ink appropriately at the time of printing. For this reason, the damper device 70 is useful in such a printer 100 in which ink is circulated through the circulation channel including the ink head 11.

In the present preferred embodiment, as illustrated in FIG. 7, the ink flowing toward the ink head 11 passes through the filter chamber 82 of the upstream damper 23 and thereafter flows into the ink head 11. As a result, even if the ink contains impurities, the filter chamber 82 collects the impurities in the recessed portion 82*a* and thereby removes the impurities. Therefore, it is difficult for such ink that contains impurities to flow into the ink head 11.

In the present preferred embodiment, as illustrated in FIG. 6, the downstream damper 92 includes the first downstream ink chamber 92*a* communicating with the downstream inflow port 91 and storing the ink, and the second downstream ink chamber 92*b* communicating with the first downstream ink chamber 92*a* and the downstream outflow port 96 and storing the ink. With this structure, the ink that has flowed out from the ink head 11 passes through two ink chambers in which the amount of ink stored therein is variable, the first downstream ink chamber 92*a* and the second downstream ink chamber 92*b*, and flows toward the downstream pump 22. As a result, pressure fluctuations are reduced in the flow channel downstream of the ink head 11 more easily.

In the present preferred embodiment, as illustrated in FIG. 6, the first downstream damper membrane 114 is provided on the first downstream ink chamber 92*a*, and is deformable inwardly and outwardly of the first downstream ink chamber 92*a* according to the amount of ink stored in the first downstream ink chamber 92*a*. The first downstream spring 115 is disposed in the first downstream ink chamber 92*a*. The first downstream spring 115 exerts an elastic force against the first downstream damper membrane 114. The second downstream damper membrane 117 is provided in the second downstream ink chamber 92*b*. The second downstream damper membrane 117 is deformable inwardly and outwardly of the second downstream ink chamber 92*b* according to the amount of ink stored in the second downstream ink chamber 92*b*. The second downstream spring 118 is disposed in the second downstream ink chamber 92*b*. The second downstream spring 118 exerts an elastic force against the second downstream damper membrane 117. In the present preferred embodiment, the damper device 70 is mounted on the carriage 4 along with the ink head 11, and the damper device 70 moves in a leftward or rightward direction. When the damper device 70 moves in a leftward or rightward direction, the pressure applied to the ink flow channel 20 in the ink supply system 10 may fluctuate. Herein, such pressure fluctuations are easily absorbed by the first downstream spring 115 and the second downstream spring 118. Herein, the first downstream spring 115 and the second downstream spring 118 easily absorb pulsation of the upstream pump 21 and the downstream pump 22.

In the present preferred embodiment, as illustrated in FIG. 5, the upstream detector 121 detects the amount of ink stored in the upstream ink chamber 84 by detecting the position of the upstream damper membrane 104. Herein, the upstream damper membrane 104 deforms inwardly and outwardly of the upstream ink chamber 84 according to the amount of ink stored in the upstream ink chamber 84. Thus, the amount of ink stored in the upstream ink chamber 84 is easily detected by detecting the position of the upstream damper membrane 104.

In the present preferred embodiment, as illustrated in FIG. 6, the downstream detector 122 detects the amount of ink stored in the first downstream ink chamber 92*a* by detecting the position of the first downstream damper membrane 114. The first downstream damper membrane 114 deforms inwardly and outwardly of the first downstream ink chamber 92*a* according to the amount of ink stored in the first downstream ink chamber 92*a*. Thus, the amount of ink stored in the first downstream ink chamber 92*a* is easily detected by detecting the position of the first downstream damper membrane 114.

In the present preferred embodiment, as illustrated in FIGS. 7 and 8, the upstream inflow port 81 and the filter chamber 82 are connected by the first upstream flow channel 83. The upstream ink chamber 84 and the upstream outflow port 86 are connected by the second upstream flow channel 85. This enables the ink that has entered from the upstream inflow port 81 to flow into the filter chamber 82 through the first upstream flow channel 83, and also enables the ink within the upstream ink chamber 84 to flow to the upstream outflow port 86 through the second upstream flow channel 85.

In the present preferred embodiment, the downstream inflow port 91 and the downstream ink chamber 92 (more specifically the first downstream ink chamber 92*a*) are connected by the first downstream flow channel 93. The downstream ink chamber 92 (more specifically the second downstream ink chamber 92*b*) and the downstream outflow port 96 are connected by the second downstream flow channel 95. This enables the ink that has entered from the downstream inflow port 91 to flow into the first downstream ink chamber 92*a* through the first downstream flow channel 93, and also enables the ink within the second downstream ink chamber 92*b* to flow into the downstream outflow port 96 through the second downstream flow channel 95.

In the present preferred embodiment, the upstream damper 23 and the downstream damper 24 preferably are provided in one damper main body 71. More specifically, the upstream inflow port 81, the filter chamber 82, the first upstream flow channel 83, the upstream ink chamber 84, the second upstream flow channel 85, the upstream outflow port 86, the downstream inflow port 91, the downstream ink chamber 92 (more specifically, the first downstream ink chamber 92*a* and the second downstream ink chamber 92*b*), the first downstream flow channel 93, the second downstream flow channel 95, and the downstream outflow port 96 preferably are all provided in the damper main body 71. Thus, the present preferred embodiment reduces the number of components because the upstream damper 23 and the downstream damper 24 are provided in one damper main body 71.

In the present preferred embodiment, as illustrated in FIG. 9, the damper devices 70 are provided on the ink heads 11. Herein, the damper devices 70 are disposed on the upper surfaces of the ink heads 11. The damper devices 70 are mounted on the carriage 4. This means that the damper devices 70 are disposed in the space above the ink heads 11. Herein, as the carriage 4 moves in a leftward or rightward direction when printing, the ink heads 11 and the damper devices 70 move together accordingly in a leftward or rightward direction. Thus, the relative position does not change between the ink heads 11 and the damper devices 70, so the ink heads 11 easily eject ink stably.

In the present preferred embodiment, the upstream outflow port 86 of the upstream damper 23 and the downstream inflow port 91 of the downstream damper 24 are provided in the bottom surface of the damper main body 71, as illustrated in FIG. 7. Each of the upstream outflow port 86 and the downstream inflow port 91 is a component that needs to be connected to the ink head 11 via the ink flow channel 20. Thus, it is possible to shorten the distance between the upstream outflow port 86 and the ink head 11 and the distance between the downstream inflow port 91 and the ink head 11.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A damper device for use in an inkjet printer including an ink head that ejects ink, an upstream flow channel connected to the ink head and through which the ink flows into the ink head, and a downstream flow channel connected to the ink head and into which the ink flows from the ink head, the damper device comprising:

an upstream damper provided in the upstream flow channel; and a downstream damper provided in the downstream flow channel; wherein the upstream damper includes:

an upstream inflow port allowing the ink to flow into the upstream damper;

an upstream ink chamber communicating with the upstream inflow port and storing the ink;

an upstream outflow port communicating with the upstream ink chamber and allowing the ink to flow out of the upstream damper; and an upstream detector detecting an amount of the ink stored in the upstream ink chamber; and the downstream damper includes:

a downstream inflow port allowing the ink to flow into the downstream damper;

a downstream ink chamber communicating with the downstream inflow port and storing the ink;

a downstream outflow port communicating with the downstream ink chamber and allowing the ink to flow out of the downstream damper; and a downstream detector detecting an amount of the ink stored in the downstream ink chamber.

2. The damper device according to claim 1, wherein the downstream ink chamber includes:

a first downstream ink chamber communicating with the downstream inflow port and storing the ink; and a second downstream ink chamber communicating with the first downstream ink chamber and the downstream outflow port, and storing the ink.

3. The damper device according to claim 2, wherein the downstream detector detects an amount of the ink stored in the first downstream ink chamber.

4. The damper device according to claim 2, further comprising:

a first downstream damper membrane provided on the first downstream ink chamber and being deformable inwardly and outwardly of the first downstream ink chamber according to an amount of the ink stored in the first downstream ink chamber; and a first downstream spring disposed in the first downstream ink chamber and exerting an elastic force against the first downstream damper membrane.

5. The damper device according to claim 4, wherein the downstream detector detects a position of the first downstream damper membrane.

6. The damper device according to claim 4, further comprising:

a second downstream damper membrane provided on the second downstream ink chamber and being deformable inwardly and outwardly of the second downstream ink chamber according to an amount of the ink stored in the second downstream ink chamber; and a second downstream spring disposed in the second downstream ink chamber and exerting an elastic force against the second downstream damper membrane.

7. The damper device according to claim 1, further comprising:

a filter chamber, communicating with the inflow port, that removes at least a portion of impurities contained in the ink; wherein the upstream ink chamber communicates with the filter chamber.

8. The damper device according to claim 1, further comprising:

an upstream damper membrane provided on the upstream ink chamber and being deformable inwardly and outwardly of the upstream ink chamber according to an amount of ink stored in the upstream ink chamber; wherein the upstream detector detects a position of the upstream damper membrane.

9. The damper device according to claim 1, further comprising:

a damper main body; wherein the damper main body includes the upstream damper and the downstream damper.

10. An ink supply system comprising:

an ink tank storing ink;

an ink head ejecting the ink onto a recording medium;

an inlet flow channel including one end connected to the ink tank;

an upstream flow channel connected to the ink head and allowing the ink to flow into the ink head;

a connection flow channel connecting the inlet flow channel and the upstream flow channel;

a downstream flow channel including one end connected to the ink head and another end connected to the connection flow channel;

an upstream pump provided in the upstream flow channel and supplying the ink to the ink head;

a downstream pump provided in the downstream flow channel and causing the ink within the ink head to flow out of the ink head; and the damper device according to claim 1, wherein:

the upstream damper of the damper device is provided between the upstream pump and the ink head in the upstream flow channel; and the downstream damper of the damper device is provided between the ink head and the downstream pump in the downstream flow channel.

11. The ink supply system according to claim 10, wherein the damper device is provided on the ink head.

12. The ink supply system according to claim 10, wherein the damper device is disposed on an upper surface of the ink head;

the damper device includes a damper main body provided with the upstream damper and the downstream damper; and the upstream outflow port and the downstream inflow port are provided in a bottom surface of the damper main body.

13. An inkjet printer comprising:

an ink supply system according to claim 10; and a platen on which a recording medium is to be placed.

* * * * *